US012098019B2

(12) United States Patent
Stockton et al.

(10) Patent No.: US 12,098,019 B2
(45) Date of Patent: Sep. 24, 2024

(54) SYSTEM AND COMPONENTS FOR RECEIVING, STORING, AND DISPENSING FLUIDS

(71) Applicant: First Element Packaging Inc., Calgary (CA)

(72) Inventors: Bob Stockton, Calgary (CA); Melanie Kobelka, Calgary (CA)

(73) Assignee: First Element Packaging Inc., Calgary (CA)

( * ) Notice: Subject to any disclaimer, the term of this patent is extended or adjusted under 35 U.S.C. 154(b) by 0 days.

(21) Appl. No.: 17/967,675

(22) Filed: Oct. 17, 2022

(65) Prior Publication Data

US 2023/0041727 A1 Feb. 9, 2023

Related U.S. Application Data

(63) Continuation of application No. 17/561,853, filed on Dec. 24, 2021, now Pat. No. 11,479,404, which is a (Continued)

(51) Int. Cl.
*B65D 83/40* (2006.01)
*B65D 83/48* (2006.01)

(52) U.S. Cl.
CPC ..... *B65D 83/40* (2013.01); *B65D 83/48* (2013.01)

(58) Field of Classification Search
CPC ..... B65D 83/40; B65D 83/48; B65D 25/20; B65D 77/06; B65D 21/0204; B65D 11/06;

(Continued)

(56) References Cited

U.S. PATENT DOCUMENTS 1,636,223 A 7/1927 Freeman
4,607,759 A 8/1986 Boetzkes (Continued)

FOREIGN PATENT DOCUMENTS

CA 2966212 A1 * 5/2016
DE 102009044314 A1 4/2011

(Continued)

*Primary Examiner* — Donnell A Long

(74) *Attorney, Agent, or Firm* — Peacock Law P.C.; Deborah A. Peacock; Justin R. Jackson

(57) ABSTRACT

A container has a top and a bottom endcap, a bottle sandwiched therebetween, and one or more bands coupling the top and bottom endcaps and the bottle. The bottle receives therein a flexible bladder. At least one of the top and bottom endcaps has a pair of opposing parallel surfaces, one of which has a protrusion extending therefrom and the other one of which has a recess therein at a location corresponding to that of the protrusion. A valving structure demountably engages with a neck portion of the bottle and has (i) a coupling valve assembly having two channels in fluid communication with the bottle and the bladder for injecting gas thereinto and dispensing liquid therefrom, respectively, and (ii) a twist-lock casing receiving therein the coupling valve assembly and removably coupled to the bottle's neck portion. The twist-lock casing has a structure for safely depressurizing the bottle.

5 Claims, 33 Drawing Sheets

Related U.S. Application Data continuation of application No. PCT/CA2020/050644, filed on May 12, 2020.

(60) Provisional application No. 62/869,764, filed on Jul. 2, 2019, provisional application No. 62/867,673, filed on Jun. 27, 2019.

(58) Field of Classification Search
CPC ..... B65D 11/08; F17C 13/04; F16K 15/18; B67D 1/0832; B67D 1/0838
USPC ..... 222/541.9, 541.6, 53.06, 153.07, 1, 562
See application file for complete search history.

(56) References Cited

U.S. PATENT DOCUMENTS

| | | | |
|---|---|---|---|
| 4,688,979 | A | 8/1987 | Kupersmit |
| 5,269,429 | A | 12/1993 | Schumacher |
| 5,678,718 | A | 10/1997 | Morris et al. |
| 6,494,336 | B1 | 12/2002 | Bylo |
| 7,152,760 | B1 | 12/2006 | Peabody |
| 7,222,741 | B2 | 5/2007 | Chmela et al. |
| D642,467 | S | 8/2011 | Knutson et al. |
| D739,500 | S | 9/2015 | Buermann |
| 9,371,161 | B2 | 6/2016 | Rudy |
| 10,145,484 | B2 | 12/2018 | Buermann |
| 10,279,982 | B2 | 5/2019 | Hanssen |
| 2015/0001381 | A1 | 1/2015 | Shimon et al. |
| 2015/0191297 | A1 | 7/2015 | Hanssen |
| 2018/0022594 | A1 | 1/2018 | Randall et al. |
| 2022/0112023 | A1 | 4/2022 | Stockton et al. |
| 2022/0243833 | A1* | 8/2022 | Cappeller ..... F17C 13/12 |
| 2023/0030669 | A1 | 2/2023 | Stockton et al. |

FOREIGN PATENT DOCUMENTS

| | | | |
|---|---|---|---|
| FR | 2967403 | A1 | 5/2012 |
| GB | 2481436 | A | 12/2011 |
| WO | WO 2017031584 | A1 * | 3/2017 |
| WO | 2020257920 | A1 | 12/2020 |

* cited by examiner

SYSTEM AND COMPONENTS FOR RECEIVING, STORING, AND DISPENSING FLUIDS

CROSS-REFERENCE TO RELATED APPLICATIONS

This application is a continuation application of U.S. patent application Ser. No. 17/561,853, titled "PRESSURIZABLE FLUID CONTAINER AND VALVING STRUCTURE THEREOF", filed Dec. 24, 2021, which is a continuation of International Application No. PCT/CA2020/050644, titled "PRESSURIZABLE FLUID CONTAINER AND VALVING STRUCTURE THEREOF", filed May 12, 2020, which claims priority to and the benefit of U.S. Provisional Patent Application No. 62/869,764, titled "DEMOUNTABLE TWO-STAGE VALVE FOR FLUID DISPENSING CONTAINERS", filed Jul. 2, 2019, and U.S. Provisional Patent Application No. 62/867,673, titled "DEMOUNTABLE TWO-STAGE VALVE FOR FLUID DISPENSING CONTAINERS", filed Jun. 27, 2019, and the specification and claims thereof are incorporated herein by reference.

BACKGROUND OF THE INVENTION

Field of the Invention

This disclosure relates to a pressurizable fluid container and valving structure thereof, and in particular relates to a pressurizable and securely stackable fluid container and a valving structure demountably engageable with the fluid container for dispensing fluid therefrom.

Background

Containers for receiving, storing, transporting and dispensing certain fluids such as beverages are designed to safely contain fluids at internal pressures greatly exceeding external atmospheric pressures. It is a common practice for fluid-container designs to exploit higher internal pressures to provide structural stiffening of the containers, whereby the internal pressure aids in resistance to the occurrence of dents, buckling, or collapse of the containers during handling and transport. For manufacturing reasons, sharp corners may be inappropriate for a pressurized-fluid container, as the internal pressure will tend to deform the container corners. Adding extra material to stiffen the corners to prevent excessive deformation under pressure may not be desirable due to increased manufacturing costs and container weights. Therefore, an ideal fluid container which is able to contain an internal pressure and is lightweight, may be a largely curved container such as a sphere or an elongated cylinder with domed ends.

Such fluid containers are exemplified by beer kegs which are typically manufactured by rolling a sheet of stainless steel into a cylinder, pressing a set of ribs into the cylinder's midpoint for added rigidity, and welding stamped-out top and bottom steel plates in place. Beer kegs are less commonly made of aluminum. Rather, stainless steel, chromium alloy, nickel, manganese and several other materials are preferable as they weld cleanly leaving a smooth joint, which may be important for food-grade containers to prevent the unwanted growth of bacteria. A modern keg is more than a simple vessel for accommodating fluid such as beer. It is built to be part of a dispensing system. In systems for tapping containers of fluid and particularly kegs of beer, a valve assembly is secured to the top of the keg to provide controllable access to the fluid for ultimately delivering the fluid from the keg to a remote position for distribution.

Regardless of the size, each beer keg contains a valve mechanism for (i) sealing the contents from the outside environment; (ii) receiving compressed gas into the keg for pressuring the beer out of the keg during fluid distribution and dispensing; and (iii) providing an exit for the beer to flow out of the keg with the help of a coupler, such as for example, a D-style coupler, a S-style coupler, a U-style coupler, an A-style coupler, a G-style coupler, an M-style coupler, and the like. The valve serves as an inlet for pressurized gas and an outlet for the pressurized beer. Beer kegs typically include a single opening on one end, commonly referred to as a "bung" and another opening at the other end thereof from which, or into which, extends a tube or "spear". Each valve consists of a spring-loaded valve mechanism connected to a tube that extends to the bottom of the keg. The valve assembly is fixed within the keg neck or other valve-receiving member to provide controlled access to the fluid located inside a pressurized container. Compressed gas is let into the headspace (above the beer) via an exit on the underside of the spring-loaded valve mechanism when the valve is tapped by a coupler or some other keg-tapping means connected to a pressure source. The pressure of the gas pushes down on the beer forcing it up through the spear that extends from the valve down to the bottom of the keg. From the valve, the beer enters the transport and dispensing system.

The keg must be kept upright, with the opening on top for the beer to be dispensed. Restaurants and bars often use a pressurized gas system to deliver a beverage from the keg to a dispensing tap. Common pressurization-gases are food-grade carbon dioxide, nitrogen, or combinations thereof. The valve system is one which allows the pressurized gas, usually carbon dioxide, to be forced into the keg but only allows the fluid to be forced out of the keg to a distribution device until the keg is entirely emptied of fluid. The gas is delivered into the headspace at the top of the keg above the beer. This pressure forces the beer, in turn, through the spear, the valve, and the delivery line to the dispensing tap.

The keg may include a flexible, air-impermeable bladder that is demountably engageable with the valve for storing the fluid while preventing contact of the fluid contained therein with pressurized gas propelled into the container during dispensing. This is crucial to ensure that the quality and flavor of the fluid stored therein (e.g., beer) are not compromised. The choice of pressurized gas is not limited solely to the gas used to carbonate the fluid.

BRIEF SUMMARY OF THE INVENTION

According to one embodiment, a container disclosed herein may comprise: a top endcap; a bottom endcap; and a bottle sandwiched between the top and bottom endcaps. The top and bottom endcaps comprise a first and a second pair of opposing parallel surfaces, wherein the first and second pairs of opposing parallel surfaces are arranged on same opposing sides; and for one pair of the first and second pairs of opposing parallel surfaces, one of said pair of opposing parallel surfaces comprises a first protrusion extending therefrom and the other one of said pair of opposing parallel surfaces comprises a first recess therein at a location corresponding to that of the first protrusion.

In some embodiments, the first recess also forms a handle.

In some embodiments, for the other pair of the first and second pairs of opposing parallel surfaces, one of said pair of opposing parallel surfaces comprises a second protrusion extending therefrom and the other one of said pair of opposing parallel surfaces comprises a second recess therein at a location corresponding to that of the second protrusion.

In some embodiments, the first and second protrusions are on a same first side.

In some embodiments, the first and second protrusions are on different sides.

In some embodiments, the top and bottom endcaps further may comprise a third and a fourth pair of opposing parallel surfaces, respectively, the third and fourth pairs of opposing parallel surfaces being perpendicular to the first and second pairs of opposing parallel surfaces; and for one pair of the third and fourth pairs of opposing parallel surfaces, one of said pair of opposing parallel surfaces comprises a third protrusion extending therefrom and the other one of said pair of opposing parallel surfaces comprises a third recess therein at a location corresponding to that of the third protrusion.

In some embodiments, the third recess also forms a handle.

In some embodiments, for the other pair of the third and fourth pairs of opposing parallel surfaces, one of said pair of opposing parallel surfaces comprises a fourth protrusion extending therefrom and the other one of said pair of opposing parallel surfaces comprises a fourth recess therein at a location corresponding to that of the fourth protrusion.

In some embodiments, the third and fourth protrusions are on a same second side.

In some embodiments, the third and fourth protrusions are on different sides.

In some embodiments, the bottle comprises a plurality of first delimiting protrusions circumferentially distributed on a shoulder thereof; and the top endcap further comprises a plurality of recesses on a bottom side thereof at locations corresponding to those of the first delimiting protrusions of the bottle for receiving therein and engaging the first delimiting protrusions of the bottle for supporting the bottle and for preventing the bottle from rotation with respect to the top endcap.

In some embodiments, the bottle further comprises a plurality of second delimiting protrusions circumferentially distributed about a bottom thereof; and the bottom endcap further comprises a plurality of recesses on a top side thereof at locations corresponding to those of the second delimiting protrusions of the bottle for receiving therein and engaging the second delimiting protrusions of the bottle for supporting the bottle and for preventing the bottle from rotation with respect to the bottom endcap.

In some embodiments, the bottle further comprises a neck portion extending from the body portion for coupling to a valving structure, said neck portion having a plurality of locking ribs extending radially outwardly therefrom.

In some embodiments, the top endcap further comprises a central opening for receiving the valving structure.

In some embodiments, the container further comprises one or more bands for coupling the top endcap, the bottle, and the bottom endcap.

In some embodiments, each of the top and bottom endcaps further comprises a pair of mutually parallel grooves for receiving therein the one or more bands.

According to one aspect of this disclosure, there is disclosed a valving structure for demountably coupling to a neck portion of a pressurizable fluid container. The valving structure comprises: a twist-lock casing for demountably coupling to the neck portion of the pressurizable fluid container, the twist-lock casing having a longitudinal bore; and a coupling valve assembly received in the longitudinal bore of the twist-lock casing. The coupling valve assembly comprises: a valve body demountably affixed between the twist-lock casing and the neck portion of the pressurizable fluid container, the valve body comprising an outer sidewall and an inner sidewall, the outer sidewall comprising a plurality of ports thereon and enclosing therein a longitudinal bore between a distal port and a proximal port thereof, the inner sidewall defining the proximal port, the annulus between the inner and outer sidewalls receiving therein an outer compressible spring; an outer valve assembly comprising a longitudinal bore and movably received in the bore of the valve body, the outer valve assembly engaging the outer compressible spring and movable between an open position for opening the bore of the valve body and a closed position for closing the bore of the valve body, the inner sidewall of the valve body engaging and aligning the outer valve assembly; and an inner valve assembly movably received in the longitudinal bore of the outer valve assembly, the inner valve assembly engaging an inner compressible spring in the longitudinal bore of the outer valve assembly and movable between an open position for opening the bore of the outer valve assembly and a closed position for closing the outer valve assembly.

In some embodiments, the outer valve assembly defines and controls the opening and closing of an outer channel through the annulus between the valve body and the outer valve assembly, the plurality of ports on the outer sidewall of the valve body, and the annulus between the valve body and the neck portion; and the inner valve assembly defines and controls the opening and closing of an inner channel through the bore of the outer valve assembly.

In some embodiments, the coupling valve assembly further comprises a bladder coupler coupled to the outer valve assembly for coupling to a flexible resilient inner container received in the pressurizable fluid container and for establishing fluid communication between the inner channel and the flexible, resilient inner container.

In some embodiments, the twist-lock casing comprises one or more windows on a sidewall thereof for engaging one or more outwardly extending protrusions on the neck portion for coupling and locking the twist-lock casing to the neck portion; each of the one or more windows comprises: a receiving window portion in connection with a container-coupling guide extending from the receiving window portion along an inner surface of the twist-lock casing to a proximal edge thereof, for receiving a corresponding one of the one or more outwardly extending protrusions of the neck portion, a locking window portion circumferentially extending from the receiving window portion, the locking window portion comprising a stopper on a proximal edge thereof at a location between the receiving window portion and the locking window portion for locking the corresponding outwardly extending protrusion in the locking window portion, and a pressure-release window portion adjacent a proximal side of the locking window portion and separated therefrom by a removable tab; the twist-lock casing is configured such that, when the removable tab of each of the one or more windows is removed, the twist-lock casing moves under a pressure from the pressurizable fluid container along a direction away from the neck portion for moving the one or more outwardly extending protrusions into their corresponding pressure-release window portions and for releasing pressure of the fluid container without decoupling the valving structure from the neck portion.

In some embodiments, the twist-lock casing comprises a plurality of ribs circumferentially uniformly distributed about the longitudinal bore of the twist-lock casing; and the valve body of the coupling valve assembly comprises at least one protrusion for fitting into the space between an adjacent pair of the plurality of ribs and engaging the adjacent pair of ribs for preventing rotation of the coupling valve assembly.

According to one aspect of this disclosure, there is provided a cover for removably coupling to a valving structure for covering a receiving chamber of the valving structure, the chamber comprising one or more inward protrusions on a sidewall thereof. The cover comprises: a covering body for covering the receiving chamber; and a sidewall extending from the covering body for being received in and engaging with the chamber, the sidewall comprising one or more gaps and one or more coupling guides each extending from a receiving end to a locking end, the receiving end in connection with one of the one or more gaps for receiving one of the one or more inward protrusions of the chamber and guiding the received inward protrusion to move therealong; at least one of the one or more coupling guides comprises a radially flexible stopper radially outwardly extending in the coupling guide, the radially flexible stopper having a sloped surface proximal to the receiving end of the coupling guide and an abrupt stopping surface distal to the receiving end thereof, the stopping surface and the locking end of the coupling guide defining a locking area for locking the inward protrusion therein; and the covering body comprises a breakable portion extending from a first edge thereof through one of the one or more gaps of the sidewall to a location adjacent a second edge opposite to the first edge such that, when the breakable portion is broken, the covering body is deformed to a connected pair of covering-body pieces laterally movable towards each other.

In some embodiments, the cover further comprises a first handle coupled to the breakable portion.

In some embodiments, the cover further comprises at least one second handle extending from the covering body for twisting the cover.

In some embodiments, the at least one second handle extends from a side of the covering body opposite to the sidewall and along a direction unparallel to the covering body.

In some embodiments, the at least one second handle extends radially outwardly from an edge of the covering body.

In some embodiments, the radially flexible stopper is a partially cut-off piece of the sidewall in the coupling guide; and a first end of the partially cut-off piece proximal to the receiving end of the coupling guide is in connection with the sidewall and a second end opposite to the first end thereof is radially outwardly biased.

In some embodiments, the sidewall in the coupling guide is radially flexible; and the stopper is radially outwardly extended from the sidewall in the coupling guide.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings:

FIG. 36A to FIG. 36E show a process of removing the tamper-evident cover shown in FIG. 33A from the valving structure shown in FIG. 6A, wherein FIG. 36A and FIG. 36B are schematic front views of the tamper-evident cover shown in FIG. 33A during the removal process, FIG. 36C is a plan view of the tamper-evident cover shown in FIG. 33A during the removal process, FIG. 36D and FIG. 36E are schematic cross-sectional views of the tamper-evident cover shown in FIG. 33A during the removal process;

DETAILED DESCRIPTION OF THE INVENTION

Embodiments disclosed herein generally relate to a pressurizable fluid container and a valving structure for demountable engagement with a neck portion extending from the container. In one embodiment, the pressurizable fluid container is in the form of a keg and comprises a top endcap, a bottom endcap, and a bottle sandwiched therebetween which are held in place by one or more bands or straps. In one embodiment, the valving structure is coupled to the pressurizable fluid container for dispensing the fluid therein and comprises a two-stage coupling valve assembly and a twist-lock casing receiving therein the two-stage coupling valve assembly.

In various embodiments, the bottle comprises an outer container or an outer housing receiving therein a compressible inner container or bladder. The outer housing comprises a neck portion and receives an inner tube in fluid communication with the bladder. The valving structure is mounted onto the neck portion of the outer housing to provide controllable access to the fluid in the inner container. When the bladder is filled with a fluid, pressurized gas may be injected into the annulus between the outer housing and the bladder to compress or pressurize the bladder to dispense the liquid therein.

The valving structure comprises a plurality of components defining an outer channel for introducing pressurized gas into the annulus between the outer housing and the bladder through the annulus between the neck portion and the inner tube for compressing the bladder and an inner channel for dispensing the liquid therethrough. Each channel is controlled by a valve assembly initially set to a closed position by way of a biasing spring and moveable to an open position for liquid dispensing. The twist-lock casing is provided with one or more slots or coupling windows, wherein each slot is configured for receiving and releasably engaging therein a corresponding rib element that extends axially outwardly from the neck portion of the outer housing. The twisting motion of the valving structure for demountably engaging a spear extending outward from a beer keg, has two stages.

In systems for tapping containers of fluid and particularly kegs of beer, the valving structure disclosed herein is secured to the top of the keg for providing access to the fluid for ultimately dispensing the fluid from the keg for distribution. The valving structure serves as an inlet for pressurized gas to go through the annulus between the neck portion and the inner tube and an outlet for the beer in the bladder of the keg. Beer kegs typically include an opening on one end thereof from which, or into which, extends a tube or "spear". Beer kegs may also include another opening commonly referred to as a "bung" for inspection.

Figure 3:
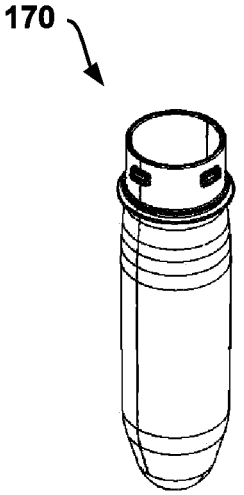
FIG. 3 is a perspective view of a preform for forming the bottle shown in FIG. 2A using blow-molding.

Turning now to FIGS. 1A to 1F, a pressurizable fluid container is shown and is generally identified using reference numeral 100. In these embodiments, the pressurizable fluid container 100 is in the form of a keg and comprises a top endcap 120, a bottom endcap 140, and a pressure-bearing bottle 160 sandwiched therebetween and held in place by a pair of bands 180. In these embodiments, the top and bottom endcaps 120 and 140, respectively, are made of high-density polyethylene (HDPE), the bands 180 are made of polyethylene terephthalate (PET), and the bottle 160 is made of PET and is blow-molded from a bottle preform 170 shown in FIG. 3.

Figure 1A:
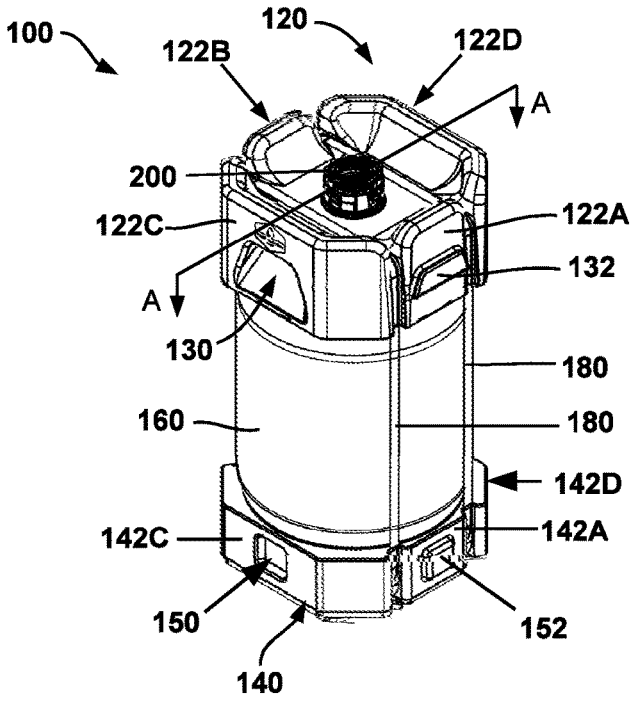
FIG. 1A is a perspective view of a pressurizable fluid container, according to some embodiments of this disclosure.
Figure 1B:
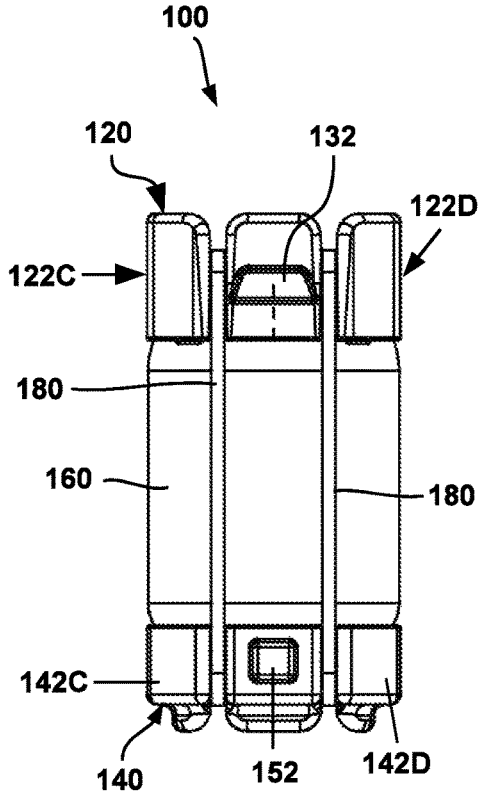
FIG. 1B and FIG. 1C are side views of the pressurizable fluid container shown in FIG. 1A, viewing from different sides thereof.
Figure 1C:
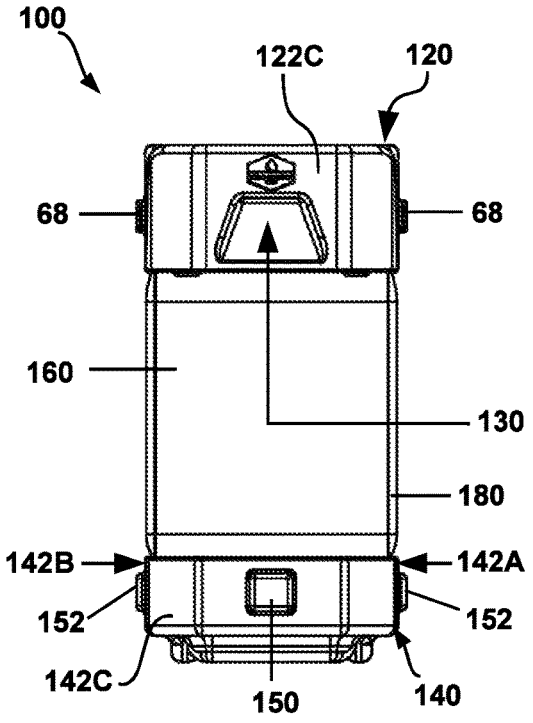
Figure 1D:
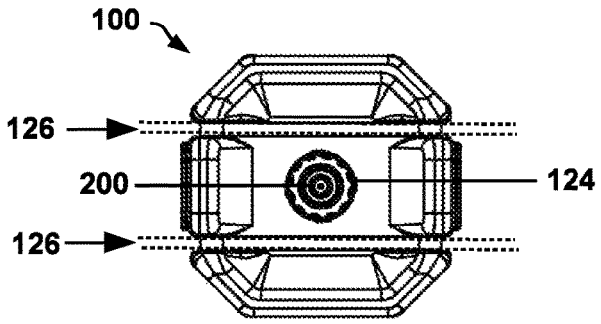
FIG. 1D is a plan view of the pressurizable fluid container shown in FIG. 1A.
Figure 1E:
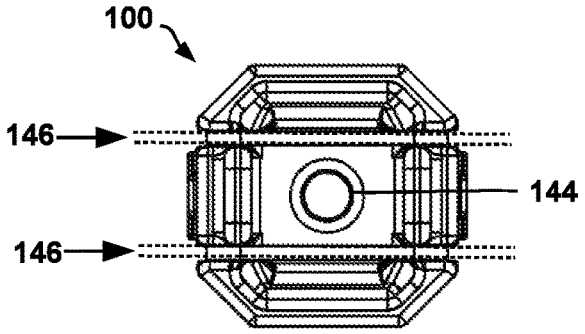
FIG. 1E is a bottom view of the pressurizable fluid container shown in FIG. 1A.
Figure 1F:
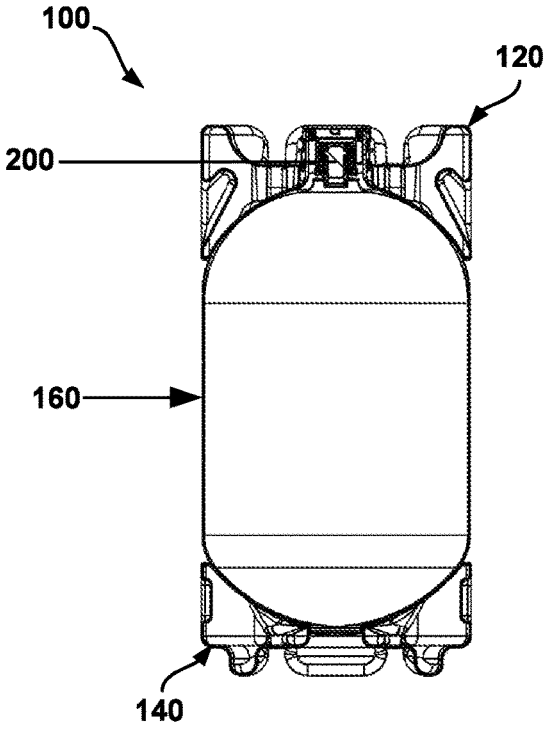
FIG. 1F is a cross-sectional view of the pressurizable fluid container shown in FIG. 1A along the cross-section line A-A.
Figure 2A:
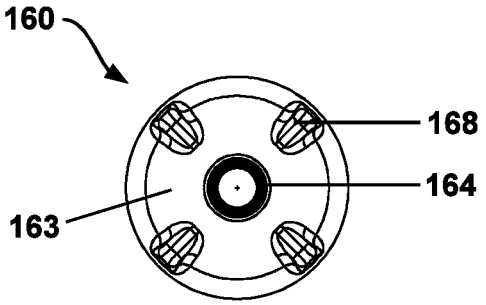
FIG. 2A is a plan view of a bottle of the pressurizable fluid container shown in FIG. 1A.
Figure 2B:
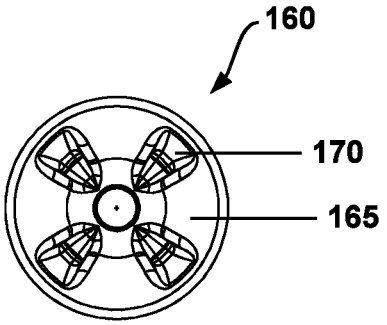
FIG. 2B is a bottom view of the bottle shown in FIG. 2A.
Figure 2C:
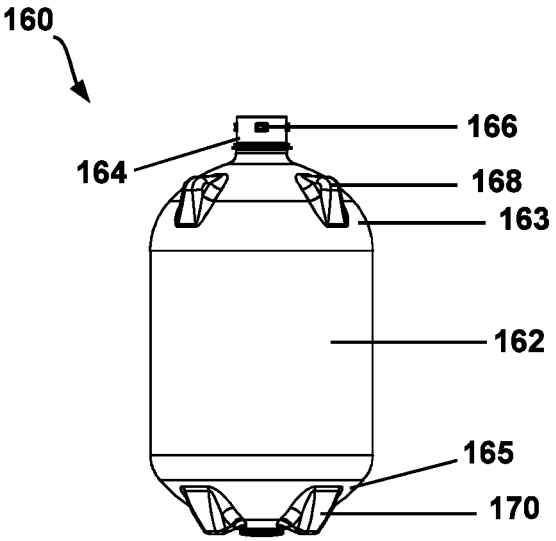
FIG. 2C is a side view of the bottle shown in FIG. 2A.

Referring to FIGS. 2A to 2C, the bottle 160 comprises a body portion 162 having a generally cylindrical shape with a generally semispherical top portion 163 and a generally semispherical bottom portion 165. The bottle 160 also comprises a neck portion 164 extending generally upwardly from the top portion 163 and comprising a plurality of locking ribs 166 extending radially outwardly therefrom for coupling to a valving structure 200 (not shown, described in more detail later). The bottle 160 further comprises a plurality of delimiting protrusions 168 circumferentially distributed on the top portion 163 and a plurality of delimiting protrusions 170 circumferentially distributed on the bottom portion 165 thereof.

FIGS. 4A to 4E show the top endcap 120. As shown, the top endcap 120 has a polygonal cross-section and comprises a plurality of opposing parallel sidewalls 122 about and coupled to a top wall 123. In the example shown in FIGS. 4A to 4E, the top endcap 120 has an octagonal cross-section and comprises four major sidewalls including a first and a second opposing parallel sidewalls 122A and 122B, respectively, perpendicular to a third and a fourth opposing parallel sidewalls 122C and 122D, respectively. The top endcap 120 also comprises four minor sidewalls 125 each intermediate an adjacent pair of main sidewalls. In this embodiment, the major and minor sidewalls 122 and 125 extend generally upwardly beyond the top wall 123 thereby forming an upwardly facing recess 127.

Figure 4A:
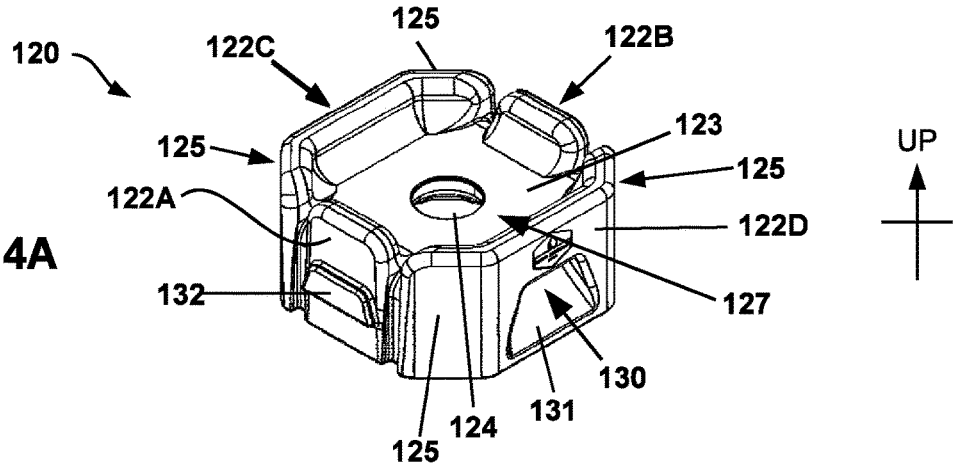
FIG. 4A is a perspective view of a top endcap of the pressurizable fluid container shown in FIG. 1A.
Figure 4B:
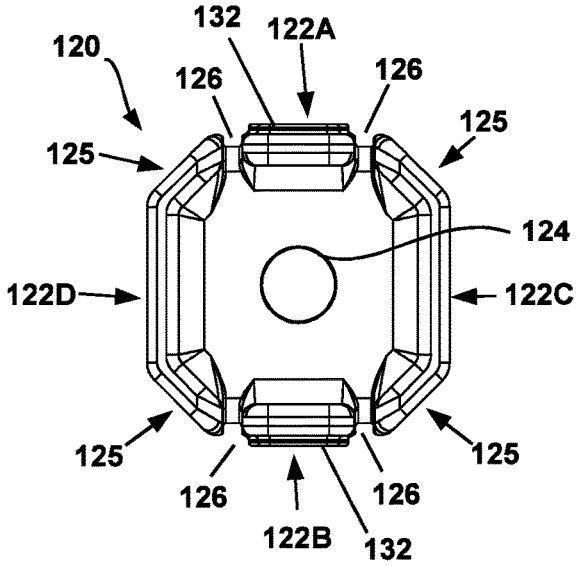
FIG. 4B is a plan view of the top endcap shown in FIG. 4A.
Figure 4C:
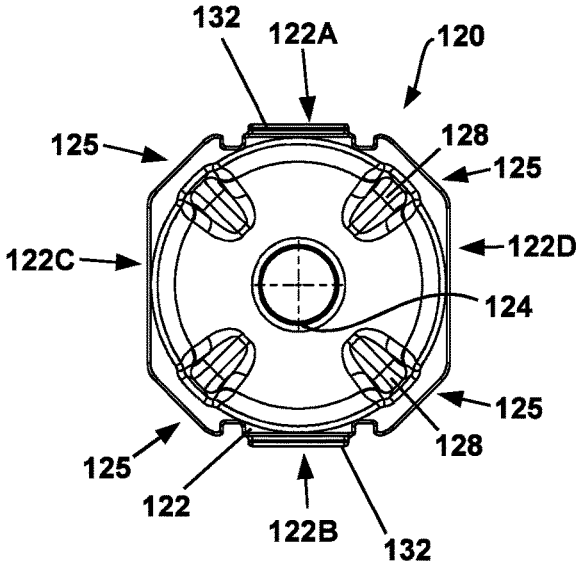
FIG. 4C is a bottom view of the top endcap shown in FIG. 4A.
Figure 4D:
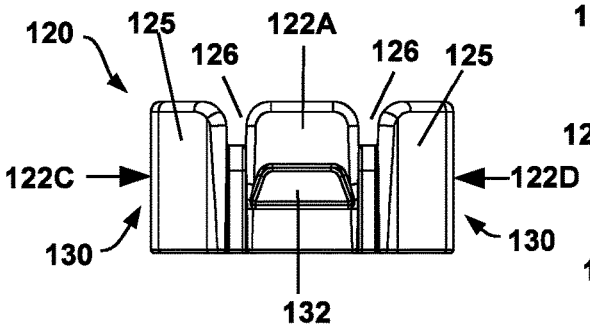
FIG. 4D and FIG. 4E are side views of top endcap shown in FIG. 4A, viewing from different sides thereof.
Figure 4E:
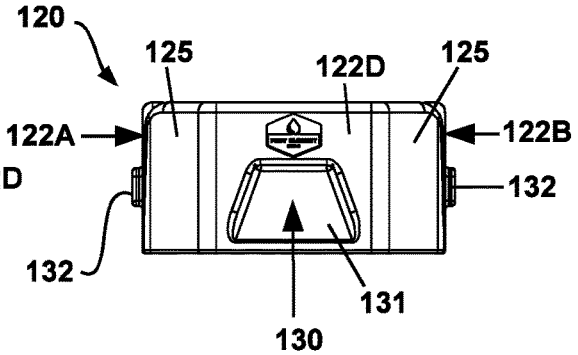
Figure 5A:
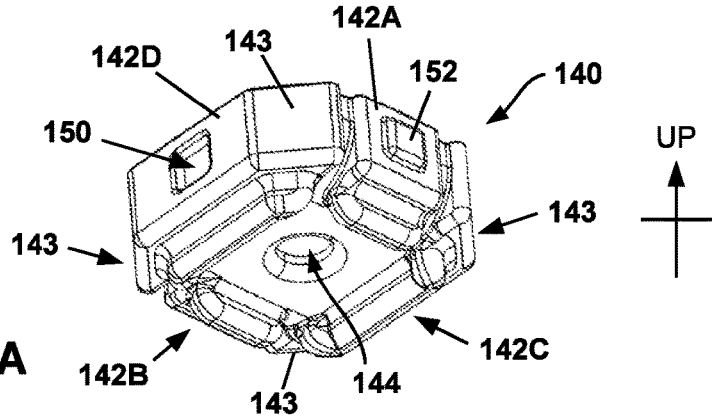
FIG. 5A is a perspective view of a bottom endcap of the pressurizable fluid container shown in FIG. 1A.
Figure 5B:
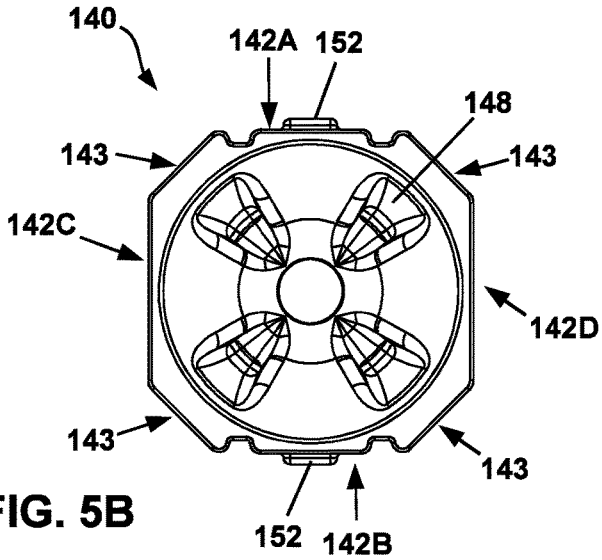
FIG. 5B is a plan view of the bottom endcap shown in FIG. 5A.
Figure 5C:
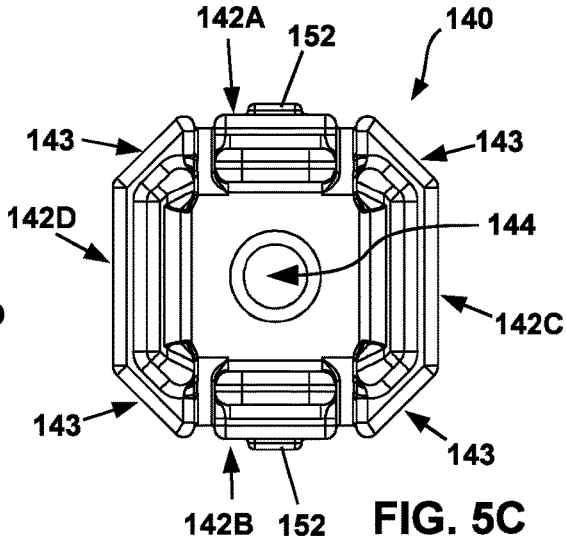
FIG. 5C is a bottom view of the bottom endcap shown in FIG. 5A.
Figure 5D:
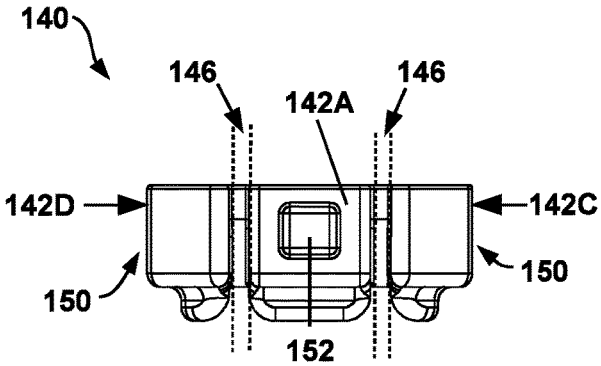
FIG. 5D and FIG. 5E are side views of bottom endcap shown in FIG. 5A, viewing from different sides thereof.
Figure 5E:
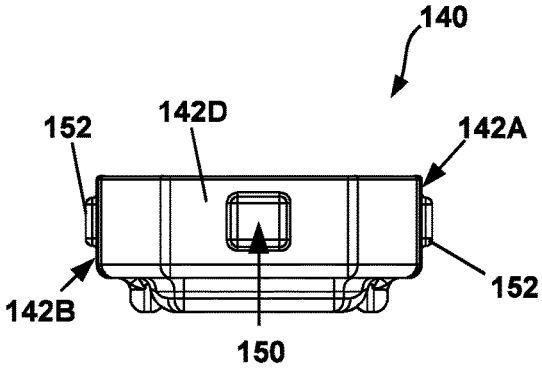

At the center of the recess 127, the top wall 123 comprises a central opening 124 for receiving the valving structure 200 (not shown; described in more detail later), and grooves 126 for receiving the bands 180 (not shown). As shown in FIG. 4C, the top endcap 120 comprises a plurality of recesses 128 on the bottom side thereof for receiving and engaging the delimiting protrusions 168 of the bottle 160 for supporting the bottle 160 and for preventing the bottle from rotation with respect to the top endcap 120.

The pair of opposing parallel sidewalls 122C and 122D comprise a pair of recesses 130, respectively, and the pair of opposing parallel sidewalls 122A and 122B comprise a pair of protrusions 132, respectively. The protrusions 132 have a shape receivable into and engageable with the recesses 130 such that when a plurality of kegs 100 are arranged side-by-side or stacked on top of each other during storage or transportation, the protrusions 132 of one keg are received into and engaged with corresponding recesses 130 of an adjacent keg to maintain the kegs 100 in place with improved stability. In these embodiments, each recess 130 also extends upwardly and inwardly and comprises a sloped inner surface 131 thereby forming a handle to facilitate operator's lifting and moving the keg 100.

FIGS. 5A to 5E show the bottom endcap 140. As shown, the bottom endcap 140 has a polygonal cross-section substantively the same as that of the top endcap 120 for allowing the keg 100 to stably lay on a surface (e.g., on a floor, on a platform, on a skid, or on another keg 100).

For example, as shown in FIGS. 5A to 5E, the bottom endcap 140 may comprise four opposing parallel major sidewalls 142 and four minor sidewalls 143, wherein the major sidewalls 142 comprise a first and a second opposing parallel sidewall 142A and 142B, respectively, perpendicular to a third and a fourth opposing parallel sidewall 142C and 142D, respectively. The bottom endcap 140 also comprises a central opening 144 for receiving the bottom of the bottle 160 (not shown), and grooves 146 for receiving the bands 180 (not shown). On the inner surface thereof, the bottom endcap 140 comprises a plurality of recesses 148 on the top side thereof for receiving the delimiting protrusions 170 of the bottle 160 to thereby support the bottle 160 and to prevent the bottle from rotating with respect to the bottom endcap 140.

The pair of opposing parallel sidewalls 142C and 142D comprises a pair of recesses 150, respectively, and the pair of opposing parallel sidewalls 142A and 142B comprises a pair of protrusions 152, respectively. The protrusions 152 have a shape receivable into and engageable with the recesses 150 (the shapes of the protrusions 152 and recesses 150 are substantively the same in the example shown in FIGS. 5A to 5E) such that when a plurality of kegs 100 are arranged side-by-side or stacked on top of each other during storage or transportation, the protrusions 152 of one keg are received into and engaged with the corresponding recesses 150 of an adjacent keg to maintain the kegs 100 in place with improved stability.

Figure 6A:
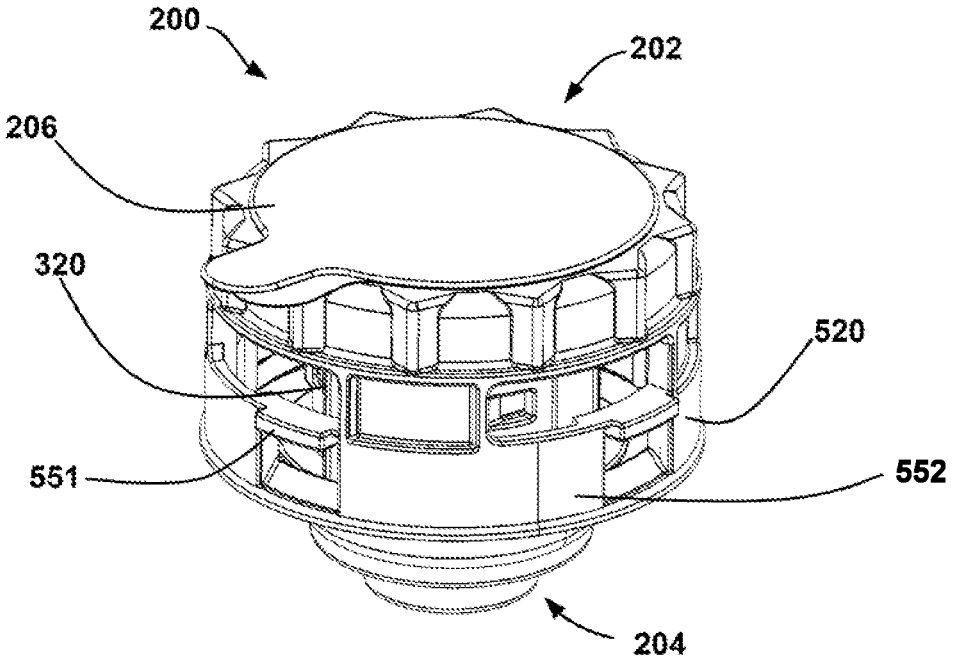
FIG. 6A and FIG. 6B show a valving structure of the pressurizable fluid container shown in FIG. 1A, according to one embodiment of the present disclosure, wherein a twist-lock cover is attached to the valving structure in FIG. 6A and is removed therefrom in FIG. 6B.
Figure 6B:
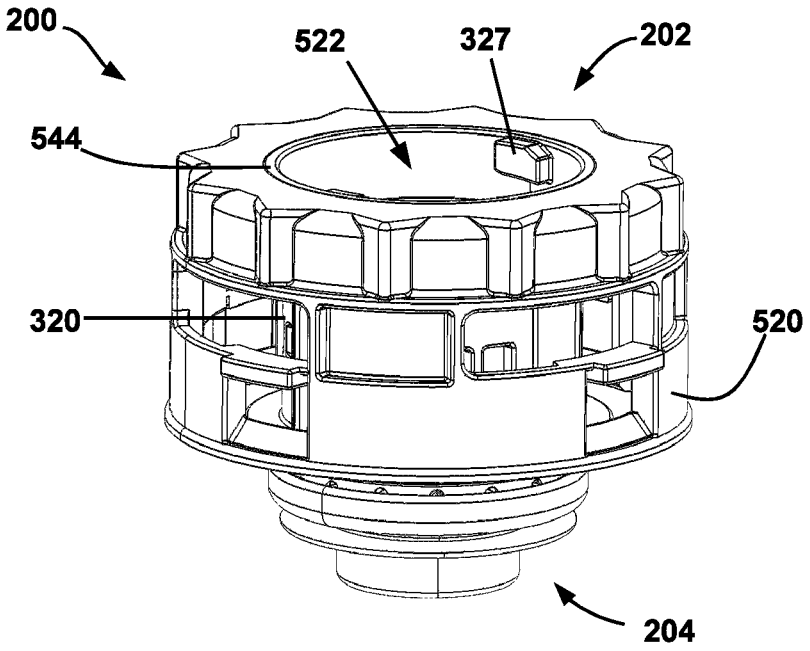

FIGS. 6A and 6B show the valving structure 200 for coupling to the neck portion 164 of the bottle 106 (see FIGS. 2A to 2C) according to one embodiment of this disclosure. In this embodiment, the valving structure 200 is in a substantially cylindrical shape with a proximal end 204 for coupling to a beer keg (not shown) and an opposite, distal end 202 having a port 522 for coupling to a coupler of a keg-tapping device such as a D-style coupler, a S-style coupler, a U-style coupler, an A-style coupler, a G-style coupler, an M-style coupler, or other suitable couplers for beer distribution. The valving structure 200 may comprise a cover 206 for protecting the port 522 and the coupling mechanism therein.

Figure 7A:
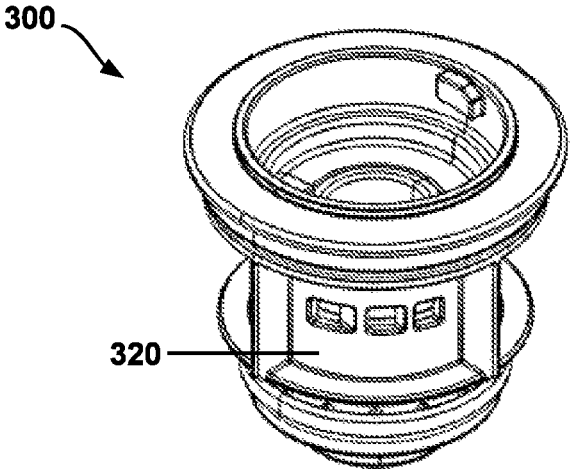
FIG. 7A is a perspective view of a coupling valve assembly of the valving structure shown in FIG. 6A.
Figure 7B:
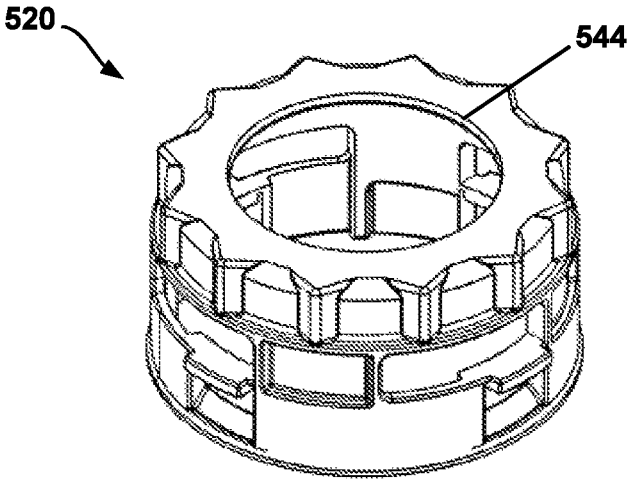
FIG. 7B is a perspective view of a twist-lock casing of the valving structure shown in FIG. 6A.

In this embodiment, the valving structure 200 also comprises a coupling valve assembly 300 as shown in FIG. 7A and a twist-lock casing 520 as shown in FIG. 7B (described in more detail later) for receiving therein the coupling valve assembly 300.

Figure 8:
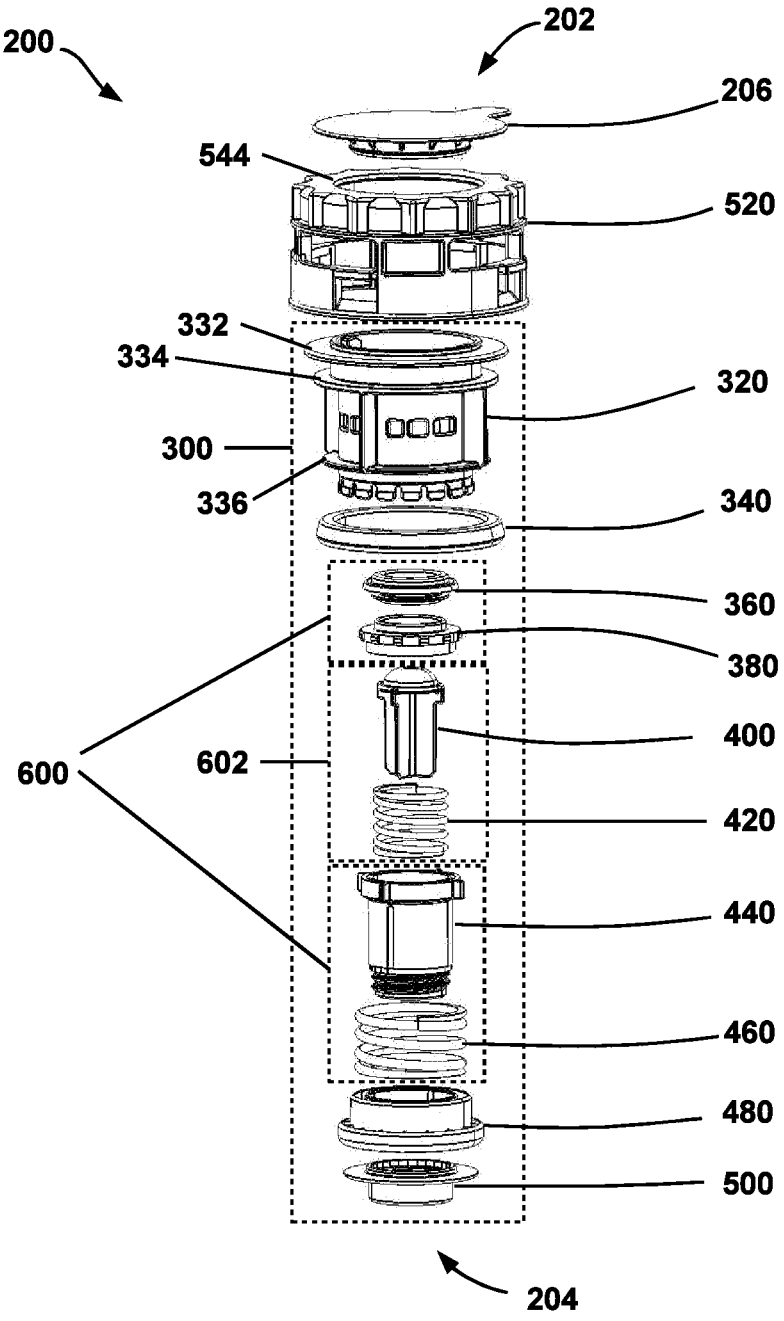
FIG. 8 is an exploded perspective view of the valving structure shown in FIG. 6A.

FIG. 8 shows an exploded perspective view of the valving structure 200. As shown, the coupling valve assembly 300 comprises a valve body 320, a sealing ring 340, a main seal elastomer 360, a main seal insert 380, an inner valve 400, a compressible inner biasing spring 420, a valve-support body 440, a compressible outer biasing spring 460, a lower retainer 480, and a threaded bladder coupler 500. The main seal elastomer 360, main seal insert 380, valve-support body 440, and the outer biasing spring 460 form an outer valve assembly 600 received in the valve body 320. The inner valve 400 and the inner biasing spring 420 form an inner valve assembly 602 received in the outer valve assembly 600.

The valving structure 200 may be made of suitable materials. For example, the twist-lock casing 520, valve body 320, main seal insert 380, inner valve 400, valve-support body 440, lower retainer 480, and bladder coupler 500 may be injection-molded or three-dimensional (3D) printed using a suitable polymer or plastic material such as polyethylene, polypropylene, and the like. The inner biasing spring 420 and outer biasing spring 460 may comprise stainless steel. The seals such as the sealing ring 340 and main seal elastomer 360 may comprise a strong but compressible material such as synthetic rubber and/or fluoropolymer elastomer sold under the trademarks VITON® (VITON is a registered trademark of Lautsprecher Teufel GmbH Corp., Berlin, Fed. Rep. Ger.) and FLUOREL® (FLUOREL is a registered trademark of Minnesota Mining & Manufacturing Co., ST. Paul. MN, USA), and/or the like.

Figure 9A:
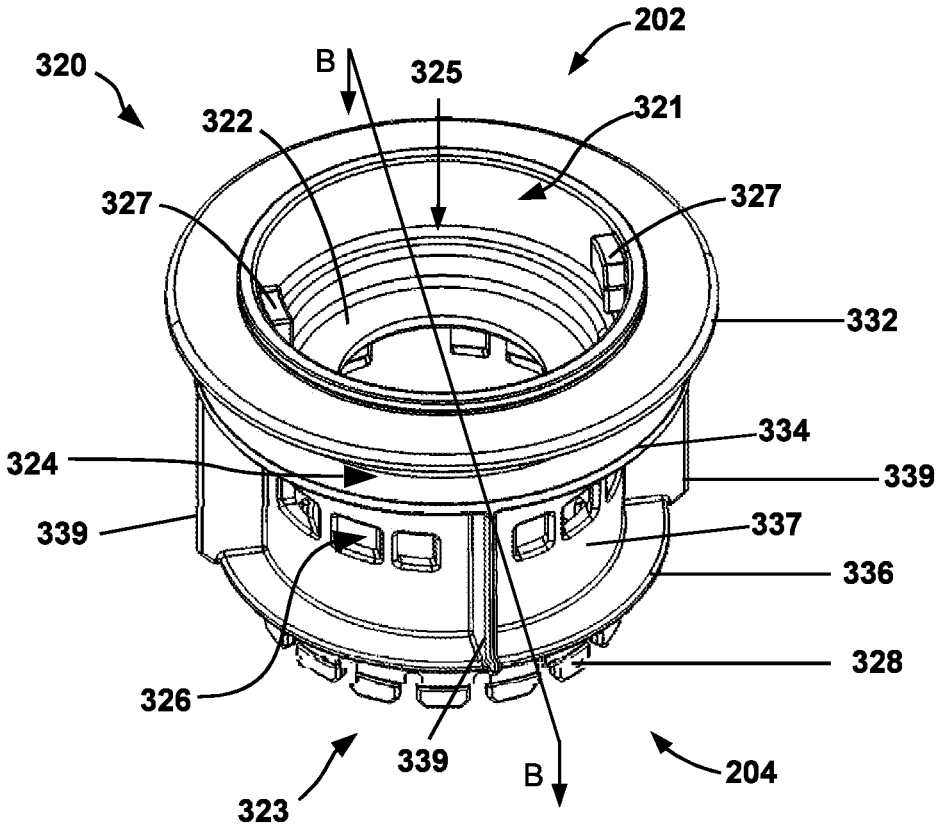
FIG. 9A is a perspective view of a valve body of the coupling valve assembly shown in FIG. 7A.
Figure 9B:
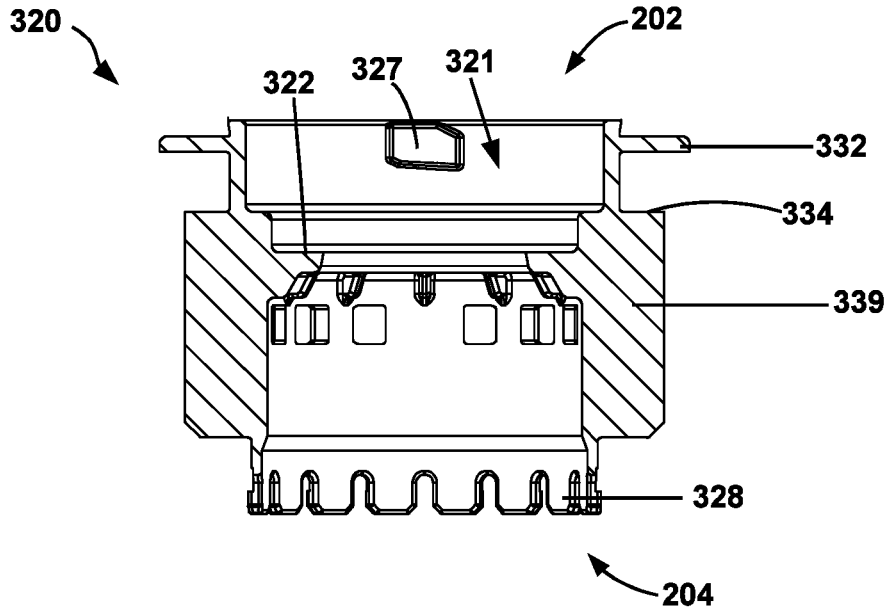
FIG. 9B is a cross-sectional view of the valve body shown in FIG. 9A along the cross-section line B-B.

Referring to FIGS. 9A and 9B, the valve body 320 is substantially cylindrical and comprises a longitudinal bore 325 extending therethrough between a proximal and distal openings 323 and 321 at the proximal and distal ends 204 and 202, respectively. The valve body 320 has a suitable size such that when the valve body 320 is received in the twist-lock casing 520, an annulus is maintained therebetween for receiving the neck portion 164 of the bottle 160.

The valve body 320 comprises a first outwardly-extending annular rim 332 at the distal end 202 thereof, a second outwardly-extending rim 334 under the annular rim 332, and a third outward-extending rim 336 near the proximal end 204 of the valve body 320. The first annular rim 332 has an outer diameter (OD) greater than that of the neck portion 164 of the bottle 160 to allow the valve body 320 to receive the neck portion 164 of the bottle 160 under the first annular rim 332, and is smaller than the inner diameter (ID) of the twist-lock casing 520 (see FIG. 6B) to allow the valve body 320 to be received in the twist-lock casing 520 under the annular rim 544 thereof.

Figure 10:
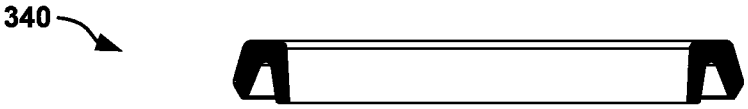
FIG. 10 is a cross-sectional view of a sealing ring of the coupling valve assembly shown in FIG. 7A.

The second annular rim 334 has an OD smaller than or equal to the ID of the neck portion 164 of the bottle 160. The first and second annular rims 332 and 334 form a circumferential recess 324 for receiving therein the sealing ring 340 (see FIG. 10) for sealably engaging the neck portion 164 of the bottle 160.

The third annular rim 336 has an OD smaller than that of the second annular rim 334 to allow fluid flow therethrough when the valving structure 200 is coupled to the neck portion 164 of the bottle 160.

In this embodiment, the valve body 320 also comprises a plurality of reinforcement bars 339 circumferentially distributed about the sidewall 337 of the valve body 320 and extending between the second and third annular rims 334 and 336, and a plurality of ports 326 on the sidewall 337 between the second and third annular rims 334 and 336.

As shown in FIGS. 9A and 9B, the valve body 320 also comprises an inwardly-extending annular rim 322 intermediate the proximal and distal ends 204 and 202 thereof, forming a chamber thereabove and open to the distal opening 321 (thus the chamber also identified using numeral 321) having a plurality of inward protrusions 327 on the inner surface thereof for receiving and engaging a coupler of a keg-tapping device (not shown). The inwardly-extending annular rim 322 is also used for engaging the main seal elastomer 360 (see FIGS. 17A and 17B).

The valve body 320 further comprises a plurality of snap-fit fingers 328 around the circumference at the proximal end 204 thereof.

Figure 11A:
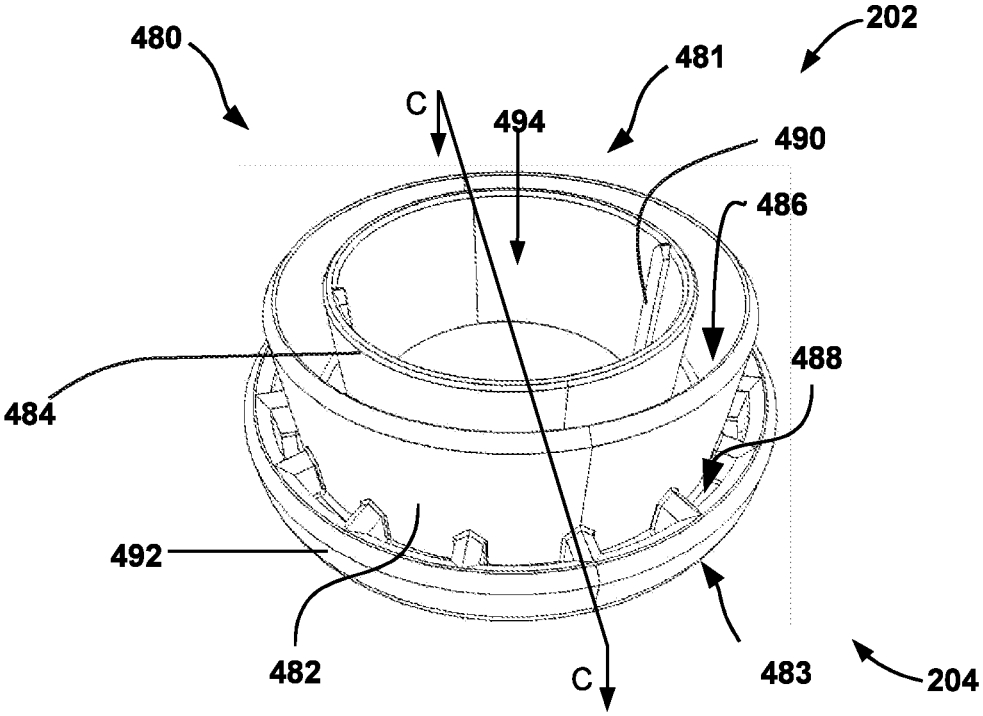
FIG. 11A is a perspective view of a lower retainer of the coupling valve assembly shown in FIG. 7A.
Figure 11B:
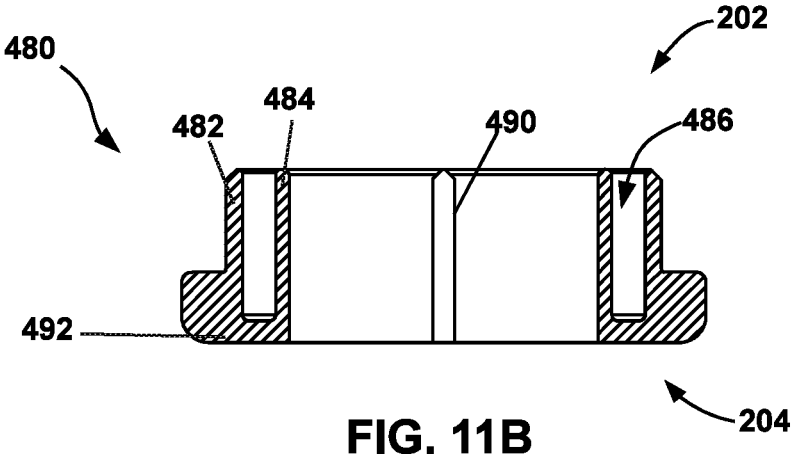
FIG. 11B is a cross-sectional view of the lower retainer shown in FIG. 11A along the cross-section line C-C.

Referring to FIGS. 11A and 11B, the lower retainer 480 comprises a flat-circular base 492, an inner sidewall 484 extending from the flat-circular base 492 and forming a longitudinal bore 494 receiving the valve-support body 440 therethrough, and an outer sidewall 482 extending from the flat-circular base 492 and enclosing the inner sidewall 484 with an annulus 486 therebetween for receiving the outer valve spring 460. The flat-circular base 492 extends radially outwardly out of the outer sidewall 482 and forms a plurality of circumferentially distributed slots 488 outside the outer sidewall 482 for engaging the snap-fit fingers 328 to couple the lower retainer 480 to the valve body 320. As shown in FIGS. 11A and 11B, the lower retainer 480 further comprises at least two longitudinal protrusions 490 located along the inner surface of the inner sidewall 484, for engaging grooves 452 on the valve-support body 440 (described later) for delimiting the valve-support body 440.

Figure 12:
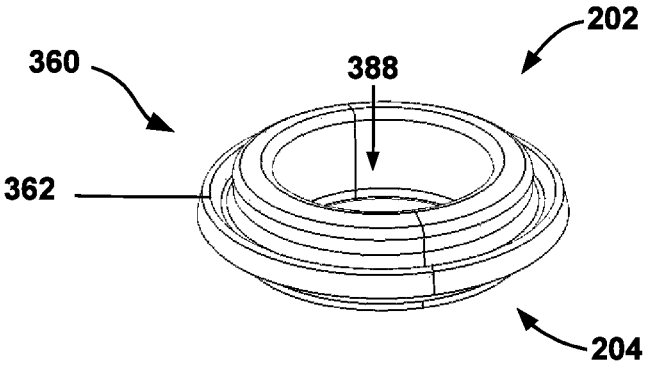
FIG. 12 is a perspective view of a main seal elastomer of the coupling valve assembly shown in FIG. 7A.
Figure 13:
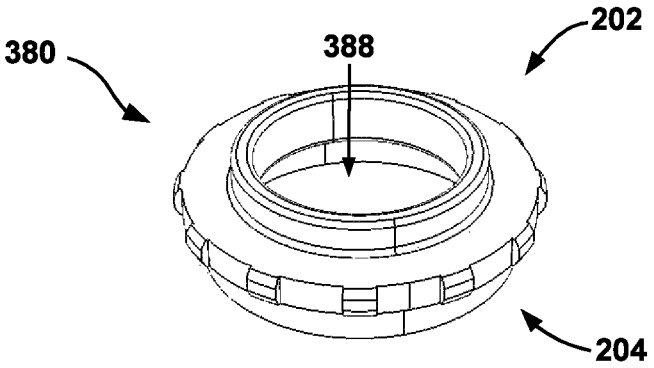
FIG. 13 is a perspective view of a main seal insert of the coupling valve assembly shown in FIG. 7A.
Figure 15A:
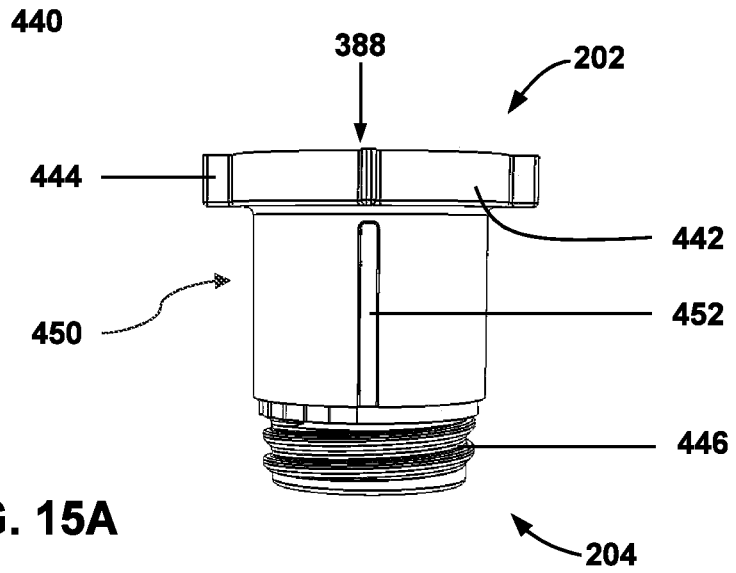
FIG. 15A is a front view of a valve-support body of the coupling valve assembly shown in FIG. 7A.
Figure 15B:
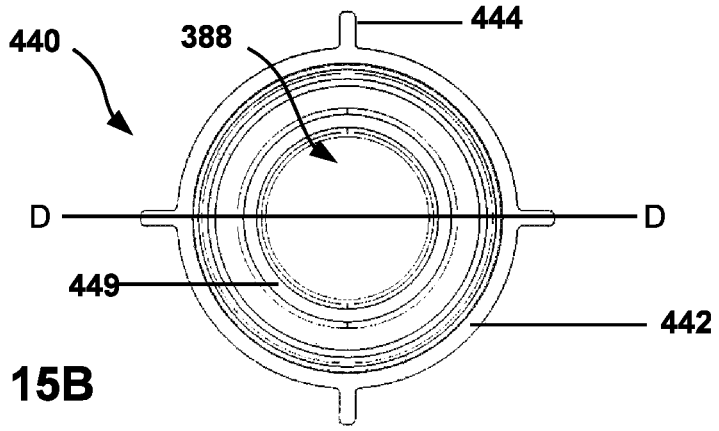
FIG. 15B is a plan view of the valve-support body shown in FIG. 15A.
Figure 15C:
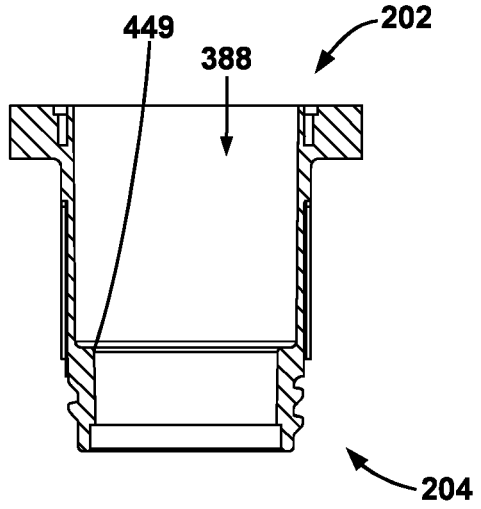
FIG. 15C is a cross-sectional view of the valve-support body shown in FIG. 15A along the cross-section line D-D.

As described above and shown in FIG. 8, the outer valve assembly 600 comprises, from the distal end 202 to the proximal end 204 thereof, the main seal elastomer 360, the main seal insert 380, the valve-support body 440, and the outer biasing spring 460. FIG. 12 shows the main seal elastomer 360 which comprises a longitudinal bore 388 extending therethrough and a top surface 362 for sealably engaging the inwardly-extending annular rim 322 in the valve body 320 (see FIGS. 9A and 9B) to close the outer valve assembly 600. FIG. 13 shows the main seal insert 380 which also comprises a longitudinal bore 388 extending therethrough and is coupled to the main seal elastomer 360 as shown in As shown in FIGS. 15A to 15C, the valve-support body 440 is substantially cylindrical and comprises an outward-extending rim 442 about the distal end 202 thereof having a plurality of protrusions 444 circumferentially distributed thereon for retaining a distal end of the outer biasing spring 460 (not shown). As described above, a proximal end of the outer biasing spring 460 is received in the annulus 486 of the lower retainer 480 and is retained by the flat-circular base 492 thereof.

Figure 18A:
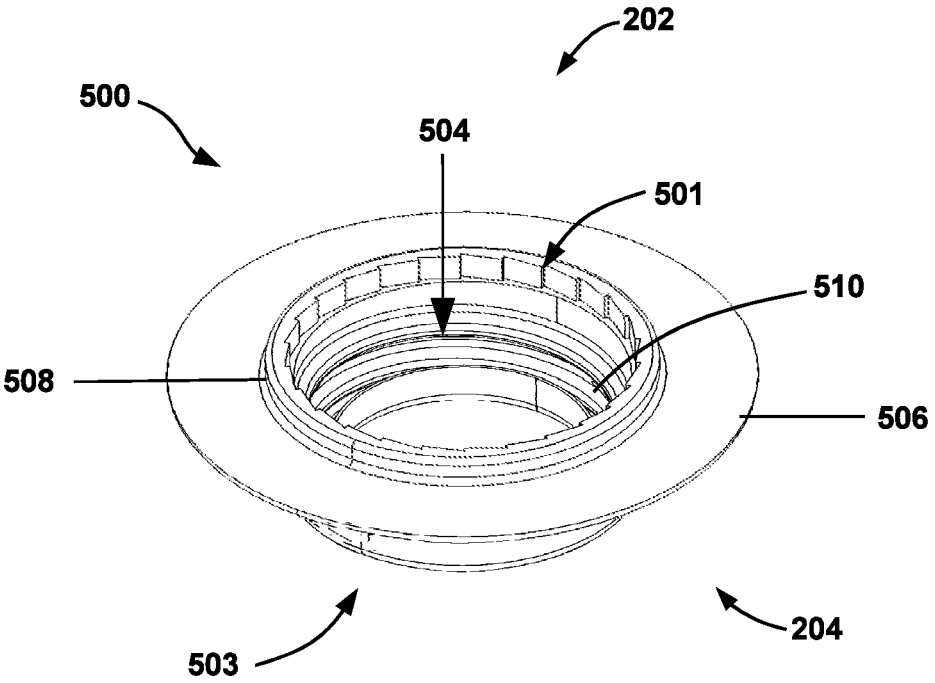
FIG. 18A and FIG. 18B are perspective and cross-sectional views of a bladder coupler of the coupling valve assembly shown in FIG. 7A, respectively.
Figure 18B:
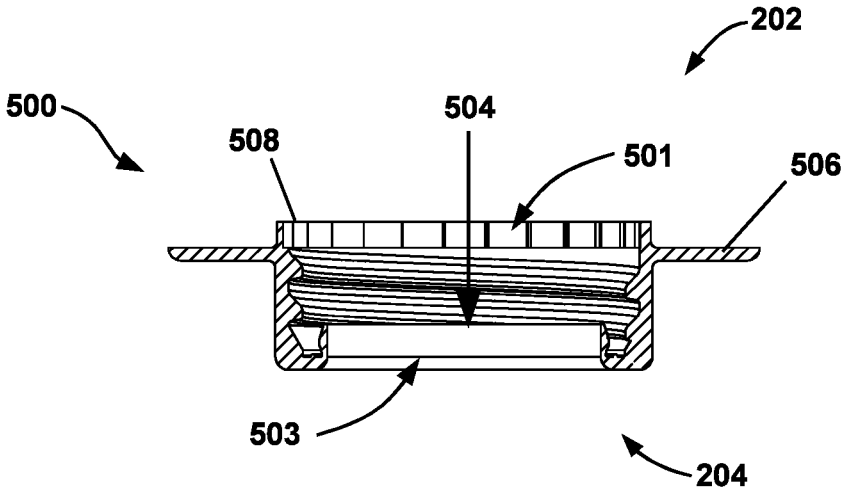

The valve-support body 440 also comprises a threaded retainer 446 about the proximal end 204 thereof for engaging a threaded bladder coupler 500 shown in FIGS. 18A and 18B. The outer surface 450 of the valve-support body 440 comprises at least two longitudinal grooves 452 for receiving and retaining longitudinal protrusions 490 of the lower retainer 480 (see FIGS. 11A and 11B). The valve-support body 440 further comprises a circumferential seat 449 (see FIG. 15C) in the longitudinal bore 388 thereof for retaining the inner biasing spring 420.

Figure 16:
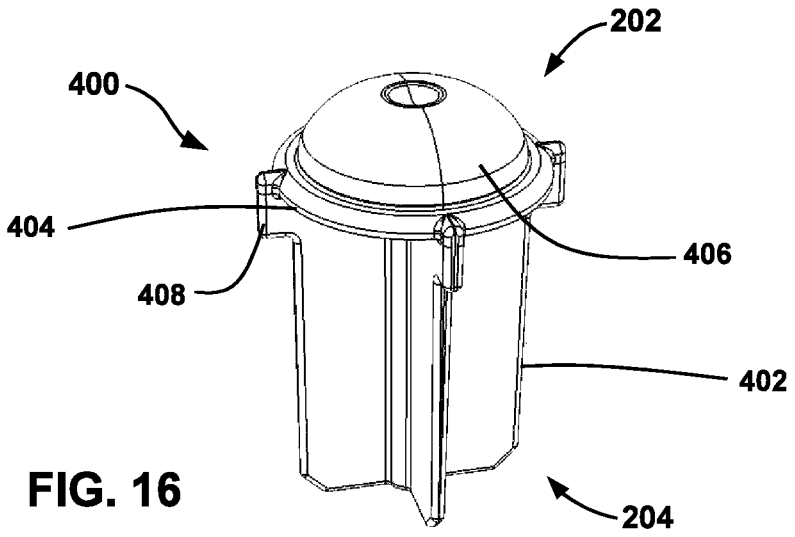
FIG. 16 is a perspective view of an inner valve of the coupling valve assembly shown in FIG. 7A.

As described above, the inner valve assembly 602 comprises an inner valve 400 and an inner valve spring 420. FIG. 16 shows the inner valve 400. As shown, the inner valve 400 in this embodiment is a poppet valve (also denoted as a "mushroom valve") and comprises a valve stem 402 extending into a valve head 404 with a convex valve gasket 406 affixed thereon for sealably engaging the main seal elastomer 360 to close the inner valve assembly 602. In this embodiment, the valve stem 402 comprises a plurality of radially outwardly extending protrusions 408 adjacent the valve head 404 for retaining a distal end of the inner biasing spring 420.

Figure 14:
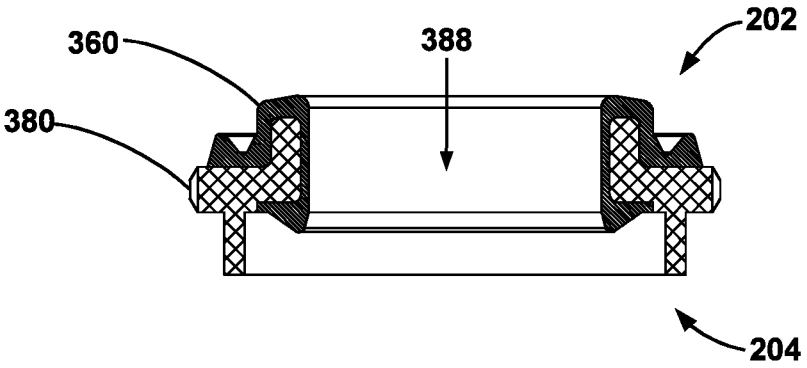
FIG. 14 is a cross-sectional view of the main seal elastomer shown in FIG. 12 coupled to the main seal insert shown in FIG. 13.
Figure 17A:
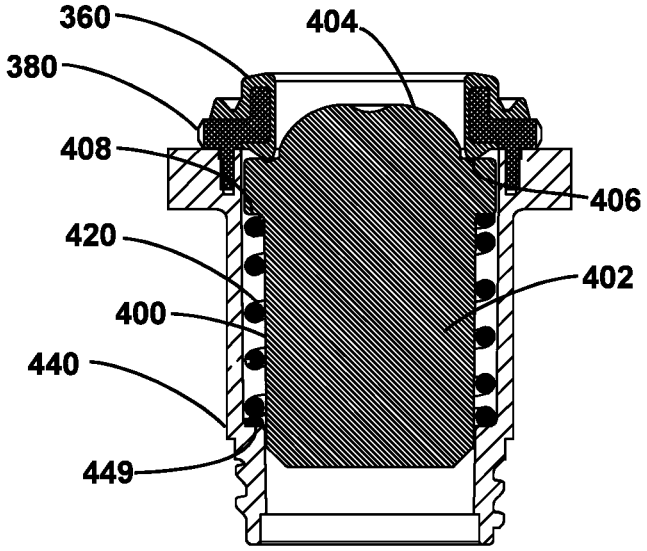
FIG. 17A and FIG. 17B are cross-sectional views of an assembled outer valve assembly and an assembled inner valve assembly of the coupling valve assembly shown in FIG. 7A.
Figure 17B:
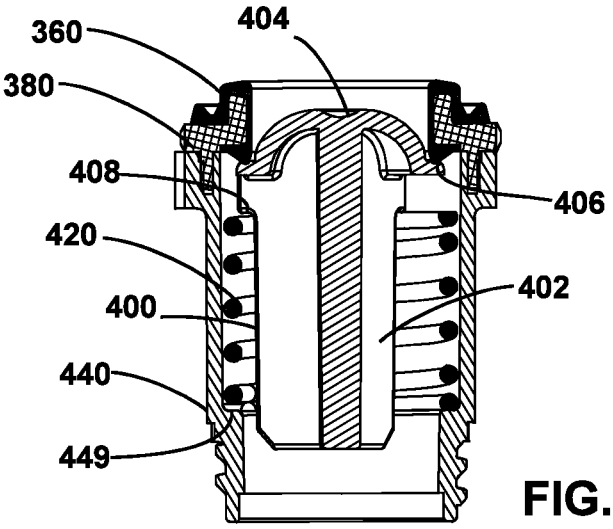

FIGS. 17A and 17B are cross-sectional views of the assembled outer valve assembly 600 (without the outer biasing spring 460) and inner valve assembly 602. As shown, the main seal elastomer 360 is coupled to the main seal insert 380 which is then coupled to the valve-support body 440 to form the outer valve assembly 600. The main seal elastomer 360 extends from the top of the main seal insert 380 along the inner surface thereof to the bottom thereof (also see FIG. 14) such that the main seal elastomer 360 may be used to seal the outer valve assembly 600 and the inner valve assembly 602, respectively, when they are in the closed positions.

The inner valve 400 and the inner biasing spring 420 of the inner valve assembly 602 are received in the valve-support body 440 with the inner biasing spring 420 retained between the radially outwardly extending protrusions 408 of the inner valve 400 and the seat 449 of the valve-support body 440. The inner biasing spring 420 biases the inner valve 400 at a closed position wherein the convex valve gasket 406 of the inner valve 400 sealably engages the main seal elastomer 360 of the outer valve assembly 600 to close the inner valve assembly 602. When a sufficient pressure is applied to the valve head 404 of the inner valve 400, the pressure may compress the inner biasing spring 420 to move the inner valve 400 downwardly thereby disengaging the convex valve gasket 406 thereof from the main seal elastomer 360 and opening the inner valve assembly 602.

FIGS. 18A and 18B shows the bladder coupler 500. As shown, the bladder coupler 500 is substantially cylindrical and comprises a longitudinal bore 504 extending therethrough between proximal and distal openings 503 and 501 at the proximal and distal ends 204 and 202, respectively. The longitudinal bore 504 comprises threads 510 on the inner surface thereof for engaging the threaded retainer 446 of the valve-support body 440 to demountably affix the bladder coupler 500 and the lower retainer 480 to the outer valve assembly 600. The distal end 202 of the bladder coupler 500 comprises an outward-extending annular rim 506 for engaging the bottom of the lower retainer 480. A top sidewall 508 extends from the annular rim 506 for inserting into the longitudinal bore 494 of the lower retainer 480 for aligning the bladder coupler 500 with the lower retainer 480 during assembling.

Figure 19:
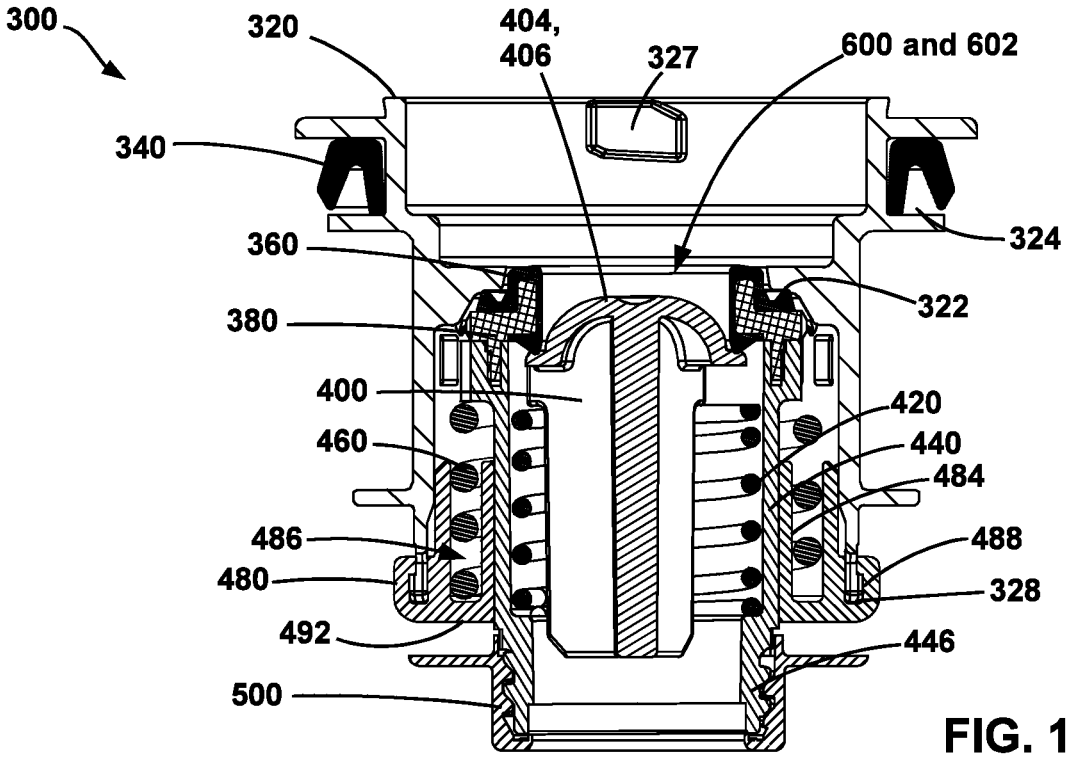
FIG. 19 is a perspective view of the coupling valve assembly shown in FIG. 7A.

As shown in FIG. 19, the coupling valve assembly 300 may be assembled by inserting the outer biasing spring 460 into the annulus 486 of the lower retainer 480 against the flat-circular base 492 thereof. The assembled outer valve assembly 600 (with the inner valve assembly 602 received therein) is then extended through the outer biasing spring 460 and the lower retainer 480 to allow the threaded retainer 446 of the valve-support body 440 to extend out of the lower retainer 480 and demountably engage the bladder coupler 500. The inner wall 484 of the lower retainer 480 receives therein and engages the valve-support body 440 of the outer valve assembly 600 for aligning the outer valve assembly 600 for ensuring the vertical movement of the outer valve assembly 600 during operation.

The assembled outer and inner valve assemblies 600 and 602 are then received into the valve body 320 and retained therein after the snap-fit fingers 328 of the valve body 320 engage respective slots 488 of the lower retainer 480. The seal ring 340 is fit into the circumferential recess 324 of the valve body 320 to complete the assembling of the coupling valve assembly 300. The inner biasing spring 420 presses the valve gasket 406 of the valve 400 against the main seal elastomer 360 to close the inner valve assembly 602. The outer biasing spring 460 presses the main seal elastomer 360 (through the valve-support body 440) against the inwardly-extending annular rim 322 of the valve body 320 to close the outer valve assembly 600.

Figure 20:
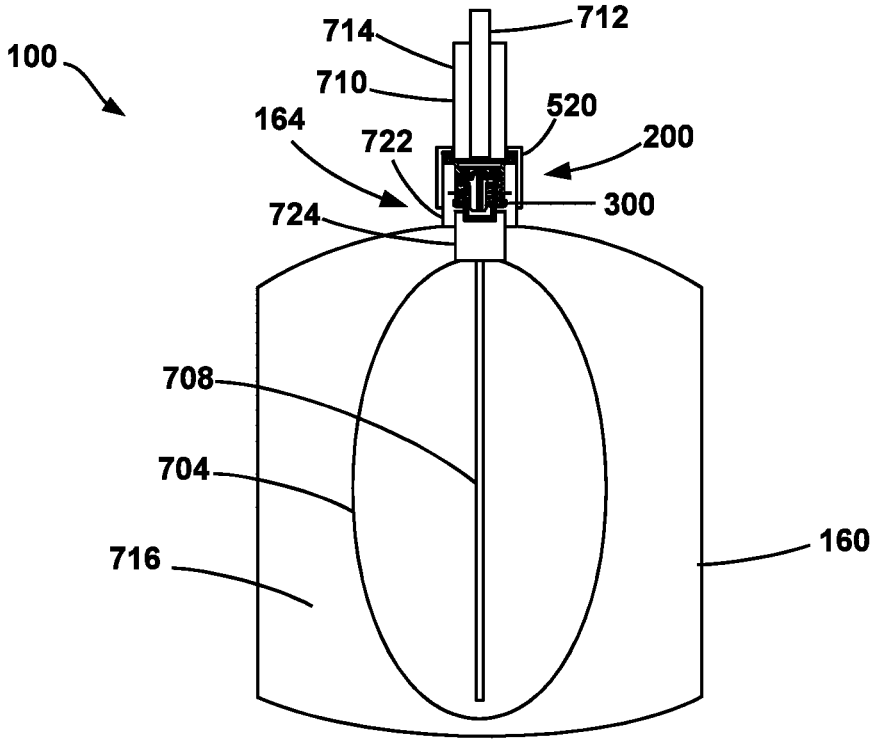
FIG. 20 is a schematic view of a keg with the valving structure shown in FIG. 6A and a coupler coupled thereto.

FIG. 20 is a schematic diagram showing the installation of the coupling valve assembly 300 and twist-lock casing 520 onto a keg 100, wherein twist-lock casing 520 functions for locking the coupling valve assembly 300 onto the keg 100. For ease of illustration, FIG. 20 only shows the bottle 160 of the keg 100 and the top and bottom endcaps 120 and 140 thereof are omitted.

As shown in FIG. 20, the bottle 160 of the keg 100 receives therein a compressible inner container 704 such as a flexible, air-impermeable bladder in fluid communication with the neck portion 164 of the bottle 160. As will be described in more detail later, the neck portion 164 comprises a pair of concentric outer and inner tubes 722 and 724 in fluid communication with the bottle 160 and the bladder 704, respectively. In some embodiments, the bladder 704 may also receive therein an elongated tube (also called a spear) 708 in fluid communication with the inner tube 724 of the neck portion 164 of the bottle 160.

The valving structure 200 (including the coupling valve assembly 300 and the twist-lock casing 520) is demountably coupled to the neck portion 164 of the bottle 160 with the outer valve assembly 600 coupled to the outer tubing 722 and the inner valve assembly 602 coupled to the inner tubing 724, as will be described in more detail later. A coupler 710 may be connected to the valving structure 200. The coupler 710 comprises a liquid channel 712 coupled to the inner valve assembly 602 for injecting liquid such as beer into the compressible inner container 704 via the spear 708 or dispensing liquid out thereof, and a gas channel 714 coupled to the outer valve assembly 600 for releasing gas or air from the annulus 716 between the outer and inner containers (i.e., the bottle and bladder) 160 and 704 when injecting liquid into the compressible inner container 704, or for propelling pressurized gas into the annulus 716 for pressing the compressible inner container 704 to dispense the liquid therefrom.

Thus, the liquid and gas in the keg 100 are never in contact thereby preventing the gas from contaminating the liquid thereby ensuring that the quality and flavor of the fluid (e.g., beer) are not compromised by the pressurized gas. Consequently, a wide variety of gas may be used for filling into the annulus 716 and, in the beer industry, the choice of pressurized gas is not limited to a gas (e.g., $CO_2$) used to carbonate the beer.

Figure 21:
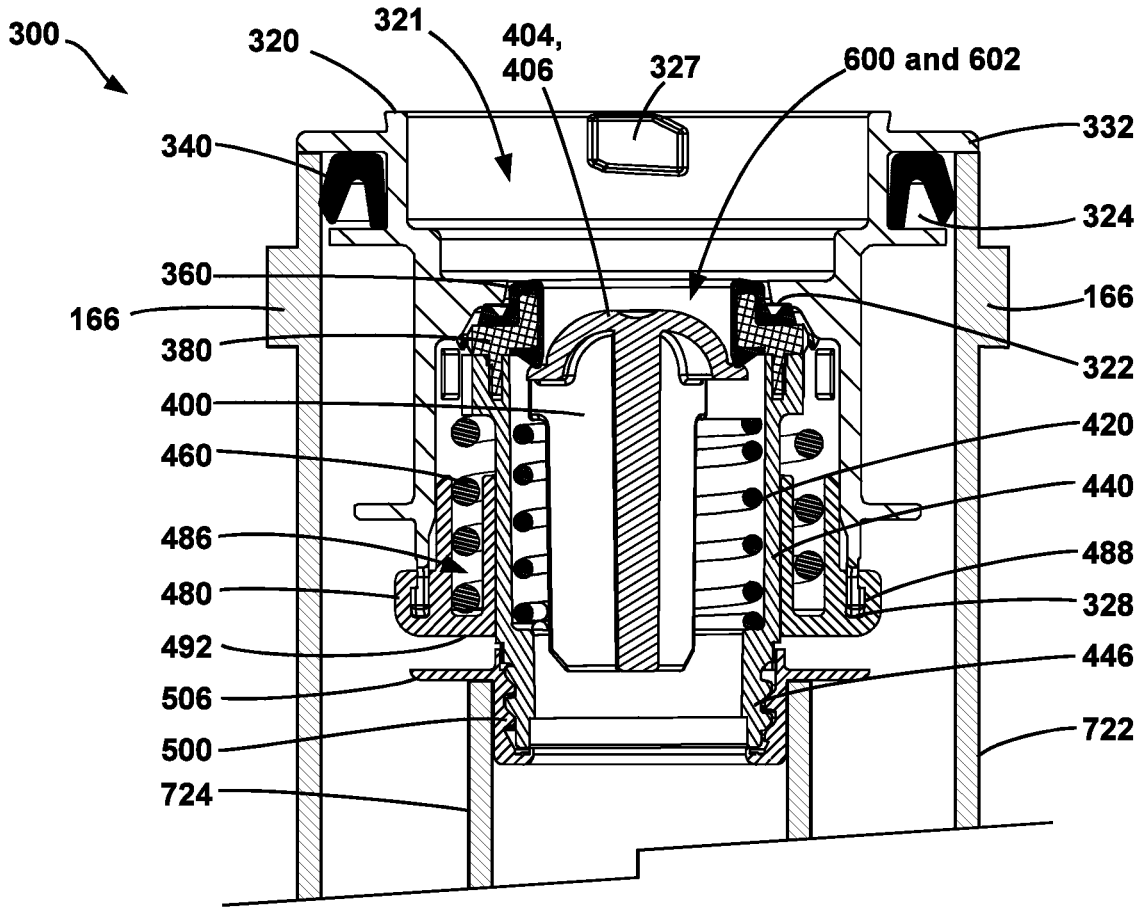
FIG. 21 is a cross-sectional view of the coupling valve assembly shown in FIG. 7A coupled to the neck portion of the keg shown in FIG. 20.

FIG. 21 shows the detail of the coupling valve assembly 300 coupled to the neck portion 164 of the bottle 160. As shown, the inner tube 724 generally sealably engages the bladder coupler 500 of the coupling valve assembly 300 and may be in sealable contact with the annular rim 506 of the bladder coupler 500. The outer tube 722 generally sealably engages the sealing ring 340 of the coupling valve assembly 300 and may be in contact with the annular rim 332 of the valve body 320. As described before, the outer tube 722 comprising a plurality of locking ribs 166 for engaging the twist-lock casing 520 to affix the coupling valve assembly 300.

The twist-lock casing 520 is then coupled to the neck portion 164 of the bottle 160 to secure the coupling valve assembly 300 to the neck portion 164 of the bottle 160 and form a complete valving structure 200.

Figure 22:
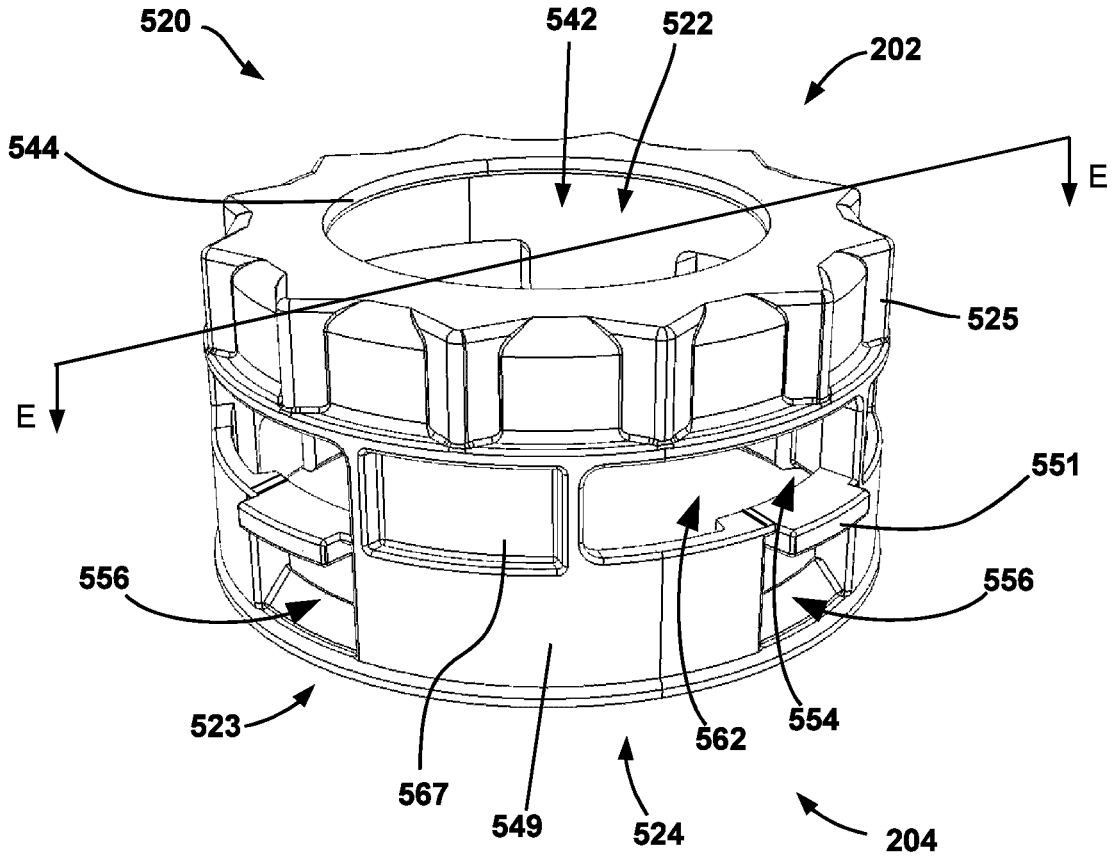
FIG. 22 is a perspective view of the twist-lock casing shown in FIG. 7B.

FIG. 22 shows the twist-lock casing 520 in one embodiment. As shown, the twist-lock casing 520 is substantially cylindrical with an outer surface 525 about the distal end 202 thereof and shaped for ease of grip during manual twisting. The twist-lock casing 520 comprises a longitudinal bore 542 extending therethrough and forming a distal and a proximal ports 522 and 524 at the distal and proximal ends 202 and 204, respectively. The twist-lock casing 520 comprises a radially-inwardly-extending annular rim 544 about the distal port 522 thereof for retaining the valve body 320 received therein. As described above and as shown in FIGS. 6A to 8, a cover 206 may be removably attached to the distal end 202 of the twist-lock casing 520 engaging the annular rim 544 thereof for protecting the port 522 and the coupling mechanism therein when no coupler is connected to the coupling valve assembly 300.

Figure 23A:
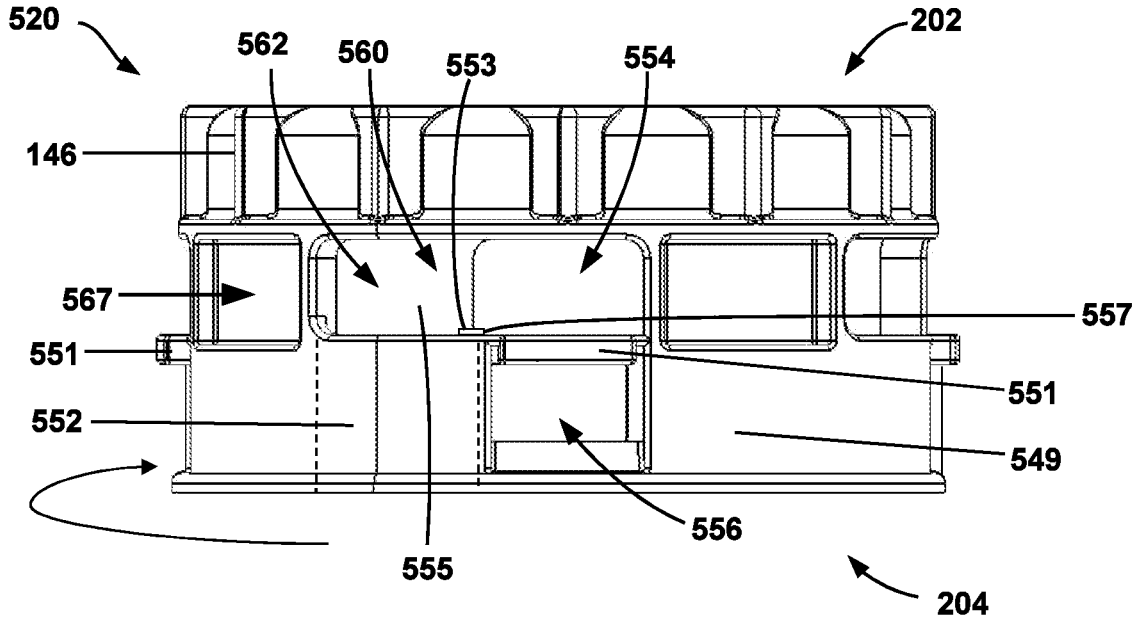
FIG. 23A is a front view of the twist-lock casing shown in FIG. 22.
Figure 23B:
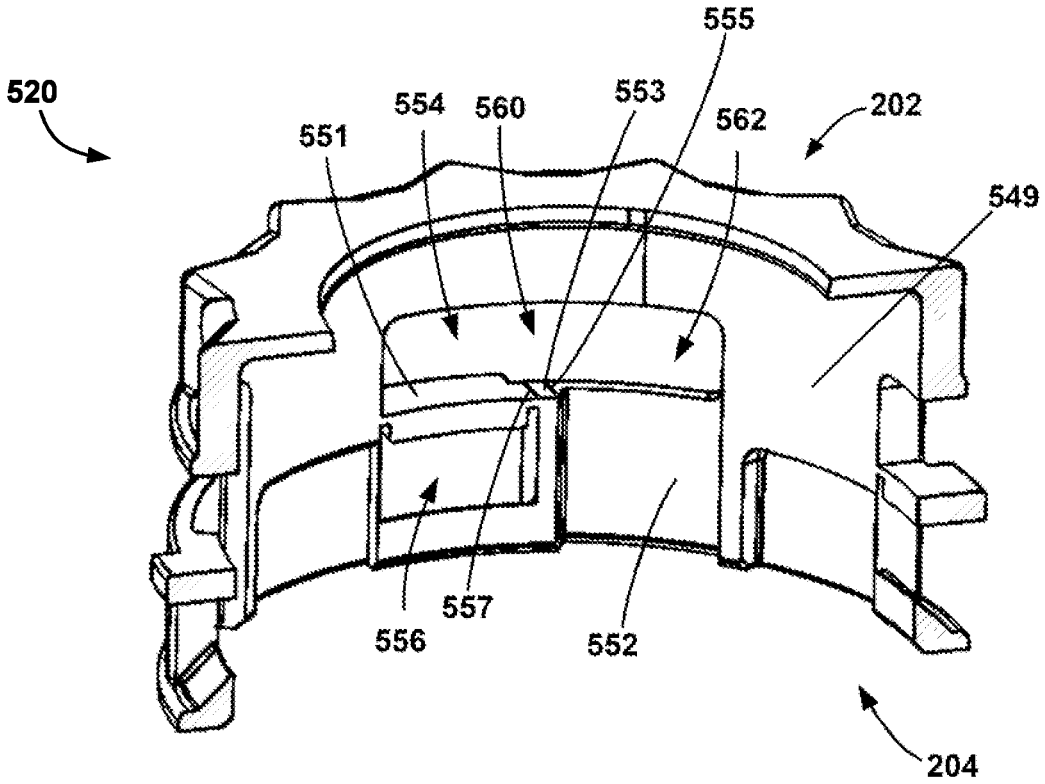
FIG. 23B is a cross-sectional view of the twist-lock casing shown in FIG. 22 along the cross-section line E-E.

The twist-lock casing 520 comprises on a proximal portion (also identified using the reference numeral 204) of the sidewall 549 thereof, a container-coupling structure for securely coupling the coupling valve assembly 300 to a keg with a pressure-release function for safety. As shown in FIGS. 23A and 23B, the container-coupling structure comprises a plurality of (such as at least two) container-coupling guides 552 in the form of recesses on the inner surface of the sidewall 549 of the twist-lock casing 520, each extending longitudinally from the proximal end 204 to a respective coupling window 560 on the sidewall 549. The twist-lock casing 520 also comprises a plurality of venting ports 567 each intermediate a pair of adjacent coupling windows 560.

Each coupling window 560 comprises a receiving portion 562 in connection with a distal end of a corresponding container-coupling guide 552 and extends circumferentially to a locking portion 554. A pressure-release window 556 is adjacent a proximal side of the locking portion 554 and is separated therefrom by a removable tab 551.

A distal edge 555 of the coupling window 560 comprises a protrusion 553 which forms a shoulder 557 at the interface between the receiving and locking portions 562 and 554 facing the locking portion 554 for locking the neck portion 164 (or more particularly a locking rib 166) of a bottle 160 (not shown) in place and securely coupling the valving structure 200 to the bottle 160 (described in more detail later).

Figure 24A:
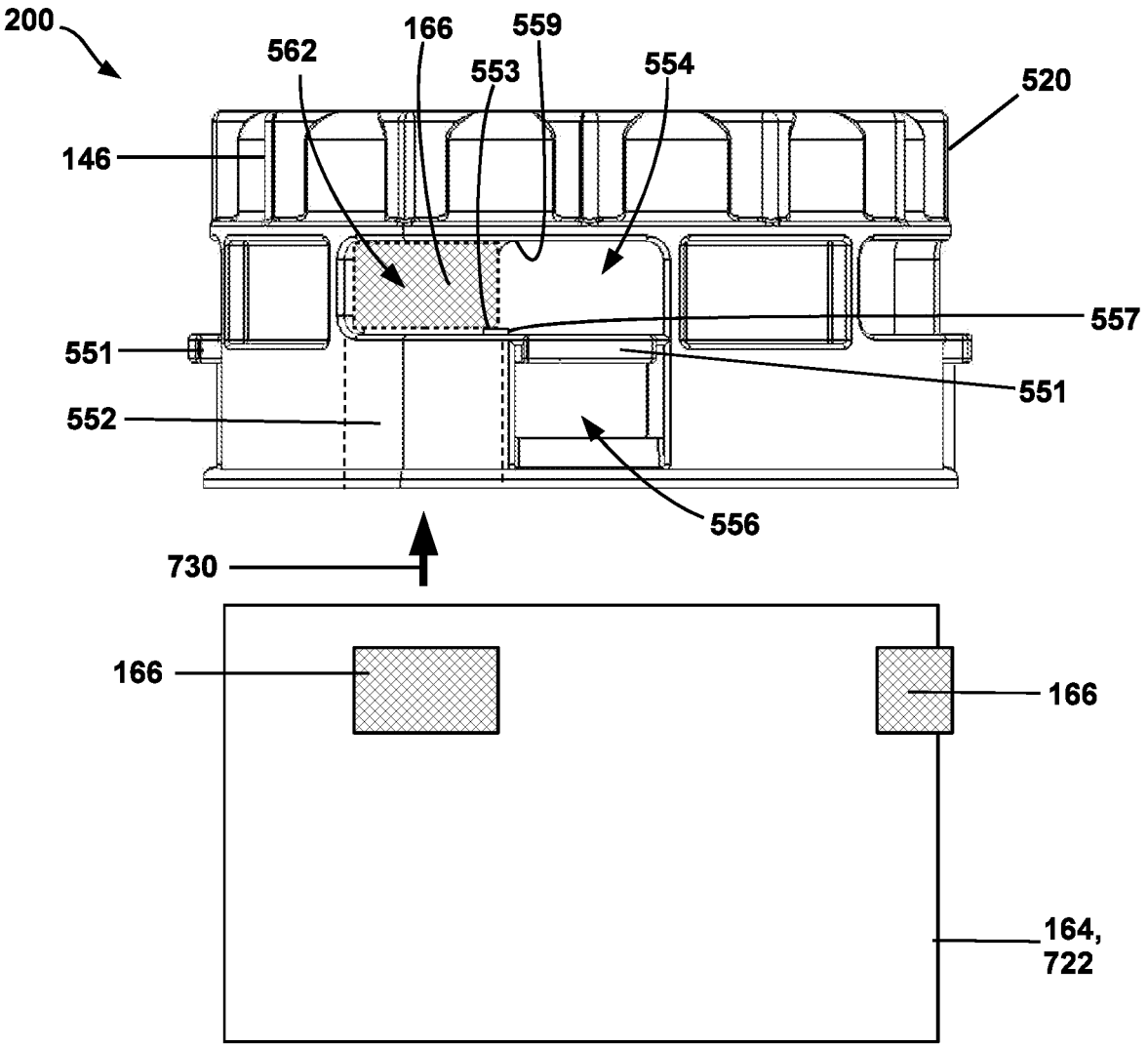
FIG. 24A to FIG. 24C are schematic front views of the valving structure shown in FIG. 6A coupling to the neck portion of a keg bottle shown in FIG. 20, for showing the installation of the valving structure by locking the twist-lock casing onto the neck portion of the keg bottle.
Figure 24B:
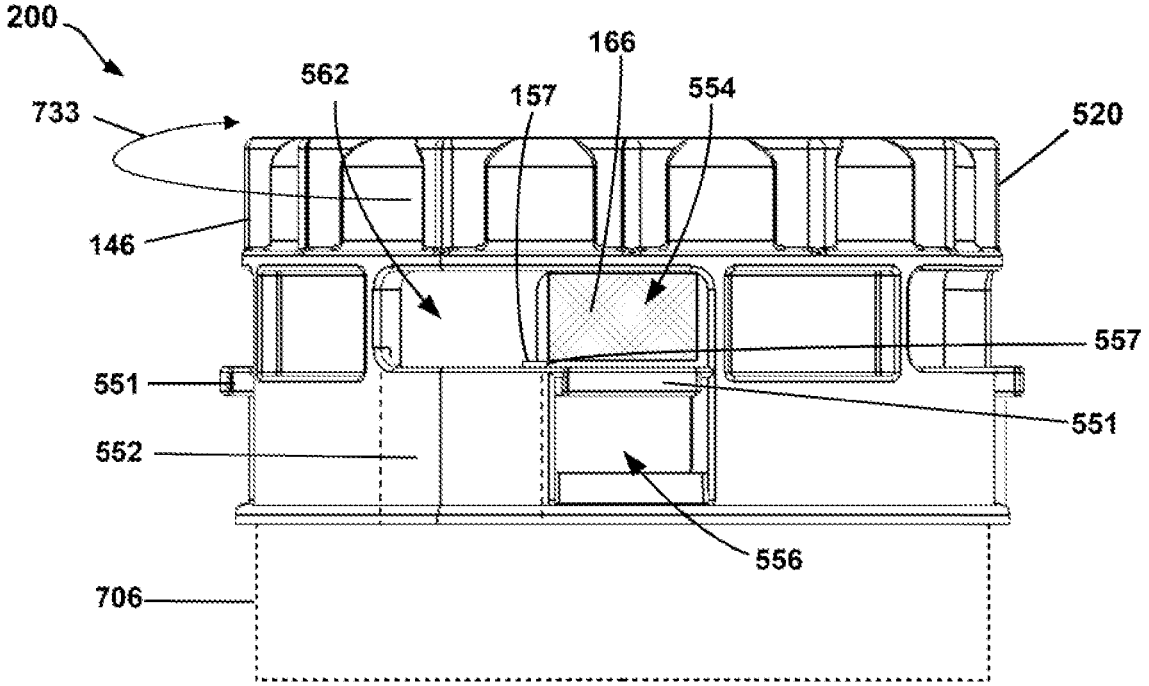
Figure 24C:
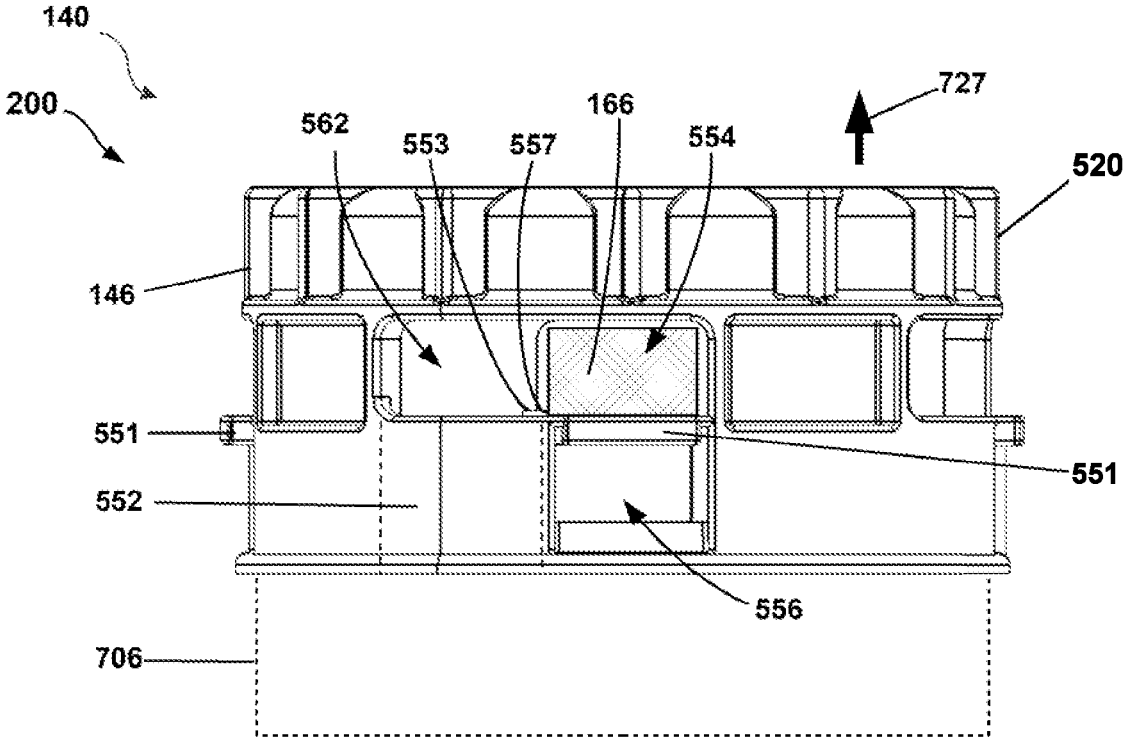

FIGS. 24A to 24C are schematic front views of a valving structure 200 and the neck portion 164 of the bottle 160 (not shown) for showing the installation of the twist-lock casing 520 of the valving structure 200 onto the neck portion 164. For ease of illustration, the coupling valve assembly 300 of the valving structure 200 is omitted.

As shown, the bottle's neck portion 164 (and in particular the outer tube 722 thereof) comprises a plurality of locking ribs 166 on the outer surface thereof at locations suitable for fitting in respective container-coupling guides 552 of the twist-lock casing 520 and sliding into the receiving portion 562 of the coupling window 560. Each locking ribs 166 has a circumferential length about the same of or slightly smaller than that of the receiving portion 562 and a longitudinal height about the same of or slightly smaller than the distance between the protrusion 553 and the distal edge 559 of the receiving portion 562 opposite thereto.

As shown in FIG. 24A, after the coupling valve assembly 300 (not shown) is coupled to the neck portion 164 of the bottle 160, the twist-lock casing 520 is pushed onto the bottle's neck portion 164 with the container-coupling guides 552 thereof aligned with the locking ribs 166 of the bottle's neck portion 164. As indicated by the arrow 730, the locking ribs 166 fit into corresponding container-coupling guides 552 and slide into corresponding receiving portions 562 of the coupling windows 560. This step is referred to herein as the "first stage" of demountable coupling of the valving structure 200 with the keg 100.

Referring to FIG. 24B, the twist-lock casing 520 is twisted or rotated (indicated by the arrow 733) to move the locking ribs 166 in the coupling windows 560 circumferentially from the receiving portions 562 into the locking portions 554 thereof. This step is referred to herein as the "second stage" of demountable engagement.

As shown in FIG. 24C, the twist-lock casing 520 is pulled at a direction away from the neck portion 164 (as indicated by the arrow 727) until the locking ribs 166 engages the corresponding tabs 551. The shoulder 557 of the protrusion 553 then prevents the locking ribs 166 from moving back to the receiving portions 562 and causing the twist-lock casing 520 to disengage the neck portion 164 of the bottle 160.

Figure 25:
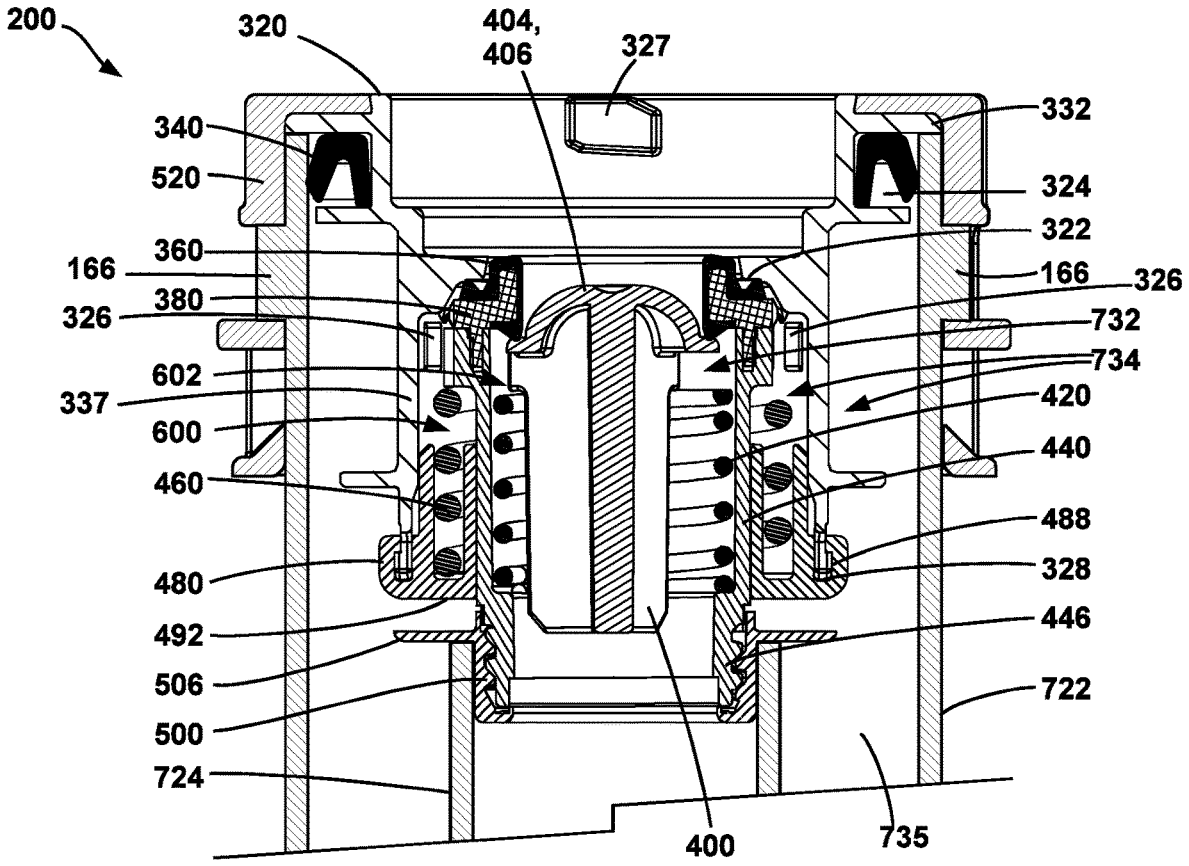
FIG. 25 is a schematic cross-sectional view of the valving structure shown in FIG. 6A coupled to the neck of the keg bottle shown in FIG. 20.

FIG. 25 shows the valving structure 200 coupled to the neck portion 164 of the bottle 160. The installation of the valving structure 200 to the neck portion 164 of the bottle 160 forms an inner channel 732 through the inner valve assembly 602 and the inner tube 724 in fluid communication with the bladder 704 (not shown), and an outer channel 734 through the outer valve assembly 600, the ports 326 on the sidewall 337 of the valve body 320, and the annulus 735 between the outer valve assembly 600 and the outer tube 722, in fluid communication with the annulus 716 (not shown) between the bottle and bladder 160 and 704. The inner and outer channels 732 and 734 are controlled by the inner and outer valve assemblies 602 and 600, respectively. As shown in FIG. 25, in a default setting, the inner and outer valve assemblies 602 and 600 are configured in respective closed configuration by the inner and outer biasing springs 420 and 460 for closing the inner and outer channels 732 and 734.

A coupler may be used to engage the valving structure 200 to open the inner and outer channels 732 and 734 for filling the bottle 160 with liquid.

Figure 26:
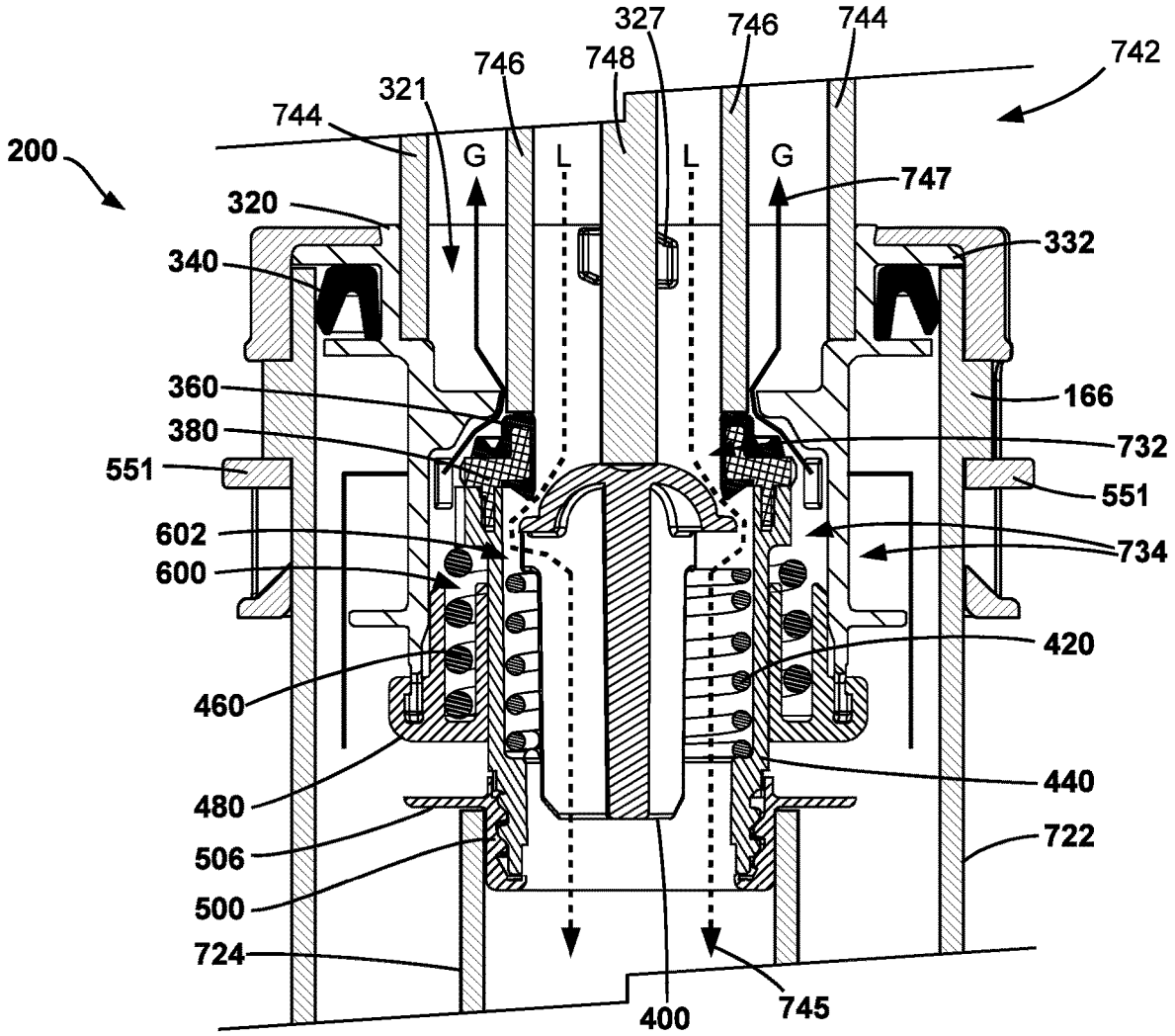
FIG. 26 is a schematic cross-sectional view of the valving structure shown in FIG. 6A coupled to the neck of the keg bottle shown in FIG. 20 with a coupler coupled to the valving structure, for showing the process of filling liquid into the keg bottle.

As shown in FIG. 26, a coupler 742 having an outer tube 744, an inner tube 746, and a central pusher 748 is extended into the chamber 321 of the valving structure 200. The outer tube 744 in this embodiment comprises one or more recesses (not shown) for engaging the protrusions 327 on the inner surface of the chamber 321 for affixing or otherwise coupling the coupler 742 to the valving structure 200. The inner tube 746 applies a downward force to the valve-support body 440 (via the main seal elastomer 360 and the main seal insert 380) and the inner tube 724 of the neck portion 164 (via the bladder coupler 500). As the inner tube 724 is coupled to the flexible bladder 704, the inner tube 746 thus downwardly biases the outer biasing spring 460 and moves the outer valve assembly 600, the bladder coupler 500, and the inner tube 724 of the neck portion 164 downward thereby configuring the outer valve assembly 600 to its open configuration and opening the outer channel 734. The central pusher 748 downwardly biases the inner biasing spring 420 and moves the inner valve 400 downward thereby configuring the inner valve assembly 602 to its open configuration and opening the inner channel 732. Liquid L is injected into the bladder or inner container 704 of the bottle 160 (not shown) via the inner channel 732 as indicated by the broken-line arrows 745 while the air or gas G in the annulus 716 between the bottle and bladder 160 and 704 is released or propelled out of the bottle 160 via the outer channel 734 as indicated by the solid-line arrows 747.

After the liquid L is filled into the bladder 704, the coupler 742 may be removed from the valving structure 200 by disengaging the recesses of the outer tube 744 of the coupler 742 from the protrusions 327 of the valving structure 200. The outer biasing spring 460 then pushes the outer valve assembly 600, the bladder coupler 500, and the inner tube 724 of the neck portion 164 upward thereby configuring the outer valve assembly 600 to its closed configuration and closing the outer channel 734. Meanwhile, the inner biasing spring 420 pushes inner valve 400 upward thereby configuring the inner valve assembly 602 to its closed configuration and closing the inner channel 732 (see FIG. 25).

Figure 27:
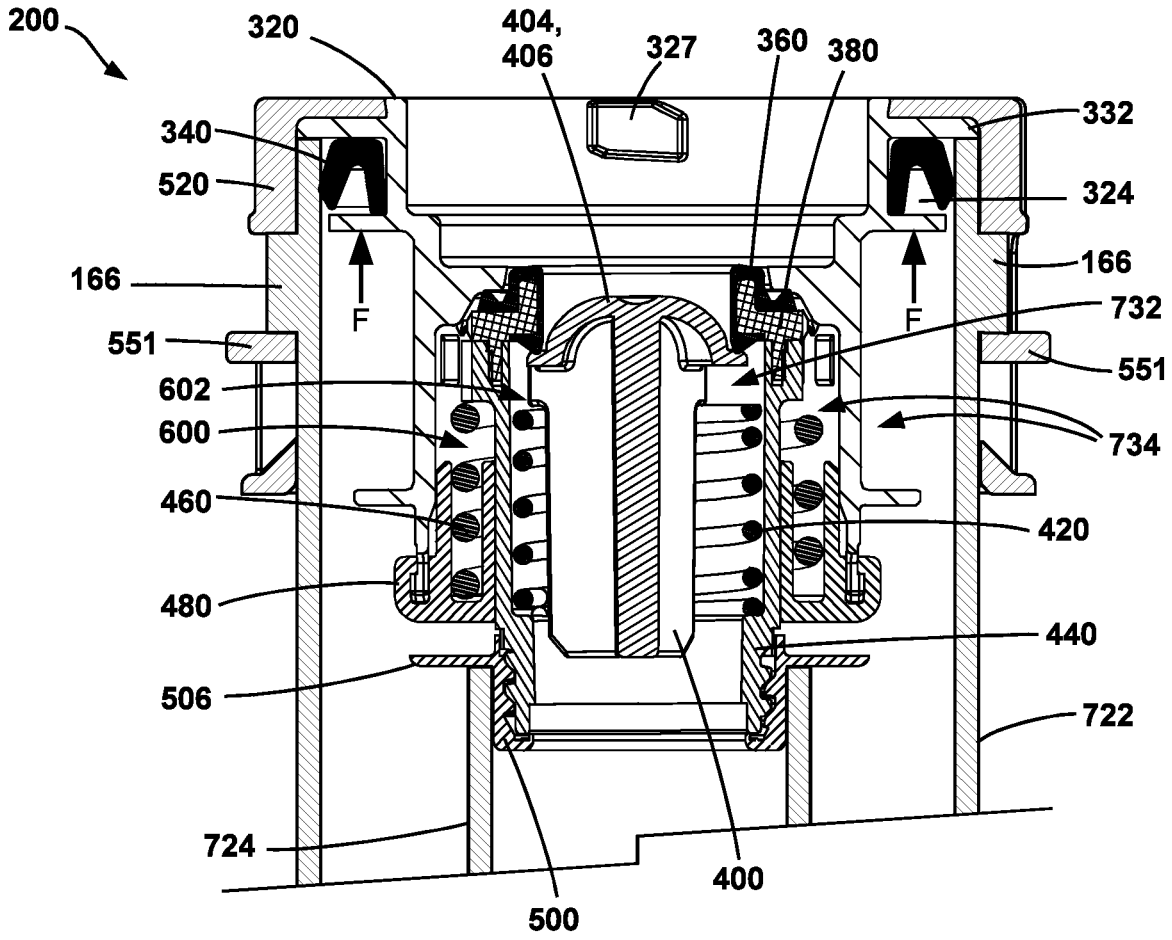
FIG. 27 is a schematic cross-sectional view of the valving structure shown in FIG. 6A coupled to the neck portion of the keg bottle shown in FIG. 20, after the coupler shown in FIG. 26 is removed.

In some embodiments, pressurized gas may be injected into the annulus 716 between the bottle and bladder 160 and 704 to pressurize the bottle 160, or alternatively the release of the air or gas G in the annulus 716 between the bottle and bladder 160 and 704 during the filling of liquid L may be controlled to maintain a suitable pressure in the bottle 160 keg. As shown in FIG. 27, the pressure in the bottle 160 applies a upward force "F" to the valve body 320 (via the second outwardly-extending rim 334) to press the valving structure 200 upward and thus presses the tabs 551 of the valving structure 200 against the corresponding locking ribs 166 of the neck portion 164 of the bottle 160 to prevent the locking ribs 166 from disengaging with the shoulders 557 of the valving structure 200 (also see FIG. 24C). Therefore, the pressure in the bottle 160 collaborates with the shoulders 557 of the valving structure 200 and the locking ribs 166 of the neck portion 164 to lock the valving structure 200 thereonto, and provides significant resistance to removal of the valving structure 200 from the bottle 160, thereby preventing accidental removal of the valving structure 200 when the bottle 160 is full or pressurized which would otherwise cause a dangerous release of pressure and/or a spill of the keg contents.

In some embodiments, the keg may be pressurized such that the force necessary to press down the valving structure 200 to disengage the locking ribs 166 from the corresponding shoulders 557 is larger than typical forces exerted on the valving structure 200 during handling.

After removing the coupler 742 from the valving structure 200, the keg 100 is ready for shipping to a consuming site such as a bar for use by engaging a coupler with the valving structure 200 to open the inner and outer channels 732 and 734 for discharging liquid from the bottle 160.

Figure 28:
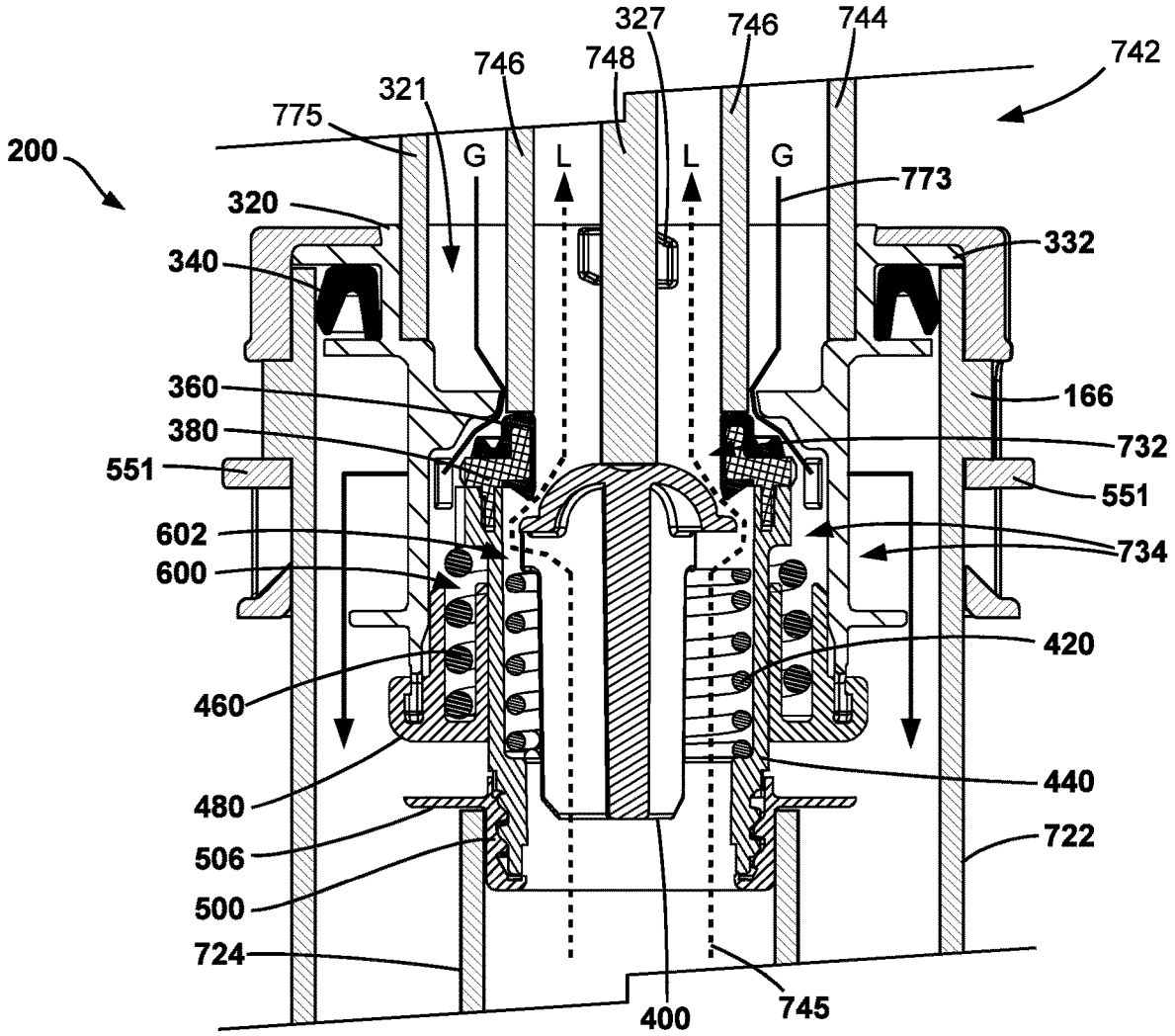
FIG. 28 is a schematic cross-sectional view of the valving structure shown in FIG. 6A coupled to the neck portion of the keg bottle shown in FIG. 20 with a coupler coupled to the valving structure, for showing the process of dispensing liquid from the keg bottle.

Referring to FIG. 28, a coupler 772 is coupled onto the valving structure 200 in a manner similar to the coupler 742 shown in FIG. 26, for configuring the outer and inner valve assemblies 600 and 602 to their open configuration and opening the inner and outer channels 732 and 734, respectively. Pressurized gas "G" is then injected the annulus of the bottle 160 (not shown) via the outer channel 734 as indicated by the solid-line arrows 773. Consequently, the beer or liquid L in the bladder 704 (not shown) is dispensed out of the bottle 160 via the inner channel 732 as indicated by the broken-line arrows 775.

In some embodiments, the valving structure 200 also comprises a safe depressurization feature allowing an operator to safely depressurize a keg 100 such as a used keg by venting the pressurized gas in a safe manner.

Figure 29A:
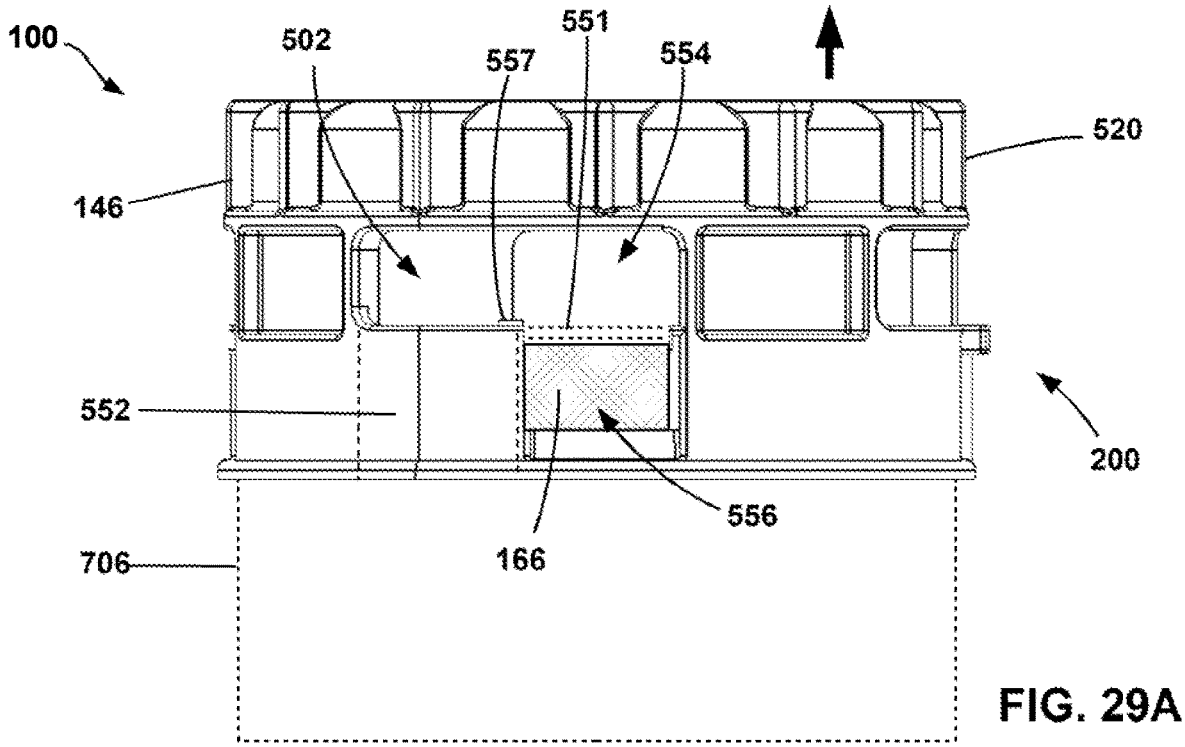
FIG. 29A and FIG. 29B are schematic front and cross-sectional views of the valving structure shown in FIG. 6A coupled to the neck portion of the keg bottle shown in FIG. 20, for showing a safe depressurization process.
Figure 29B:
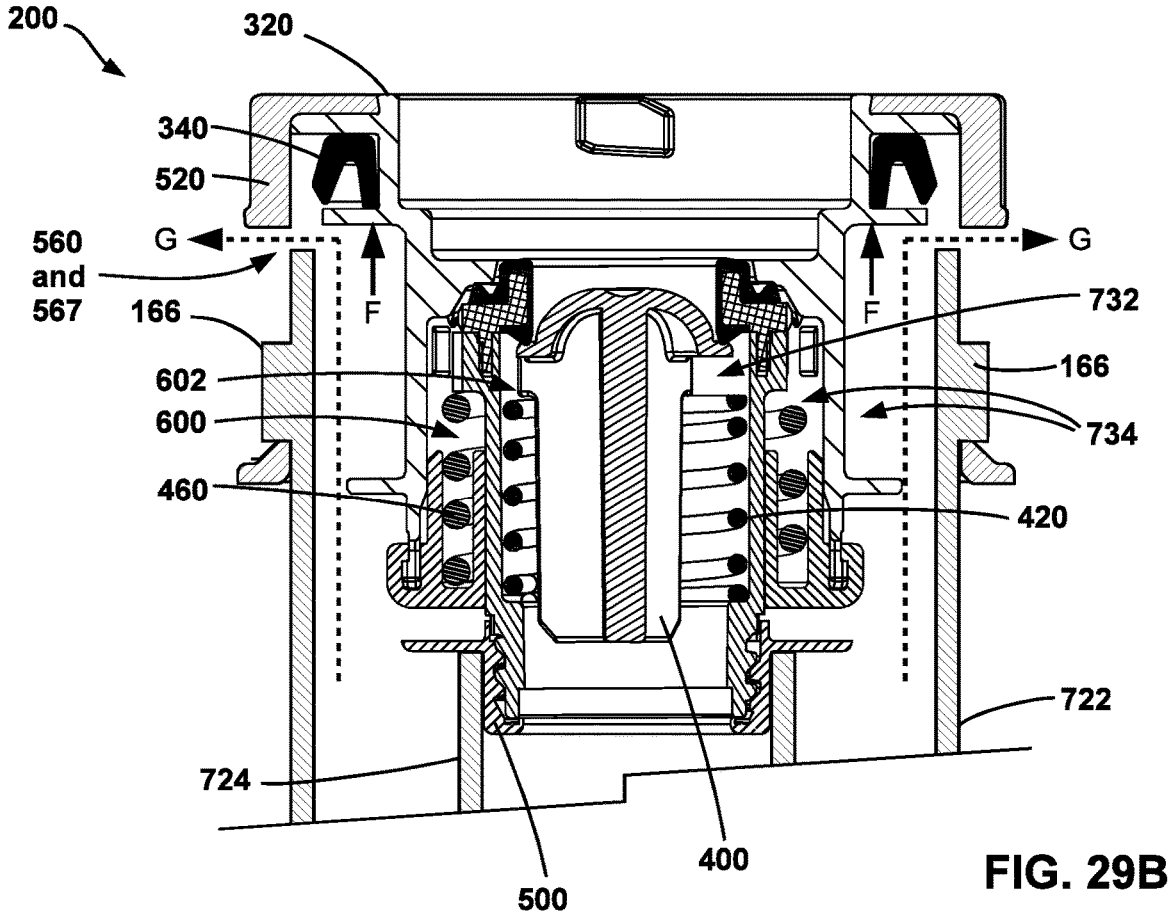

As shown in FIG. 29A, to depressurize a keg 100 having a valving structure 200, an operator may break the tabs 551 of the valving structure 200. As shown in FIG. 29B, the gas pressure in the bottle 160 then applies an upward force "F" to the valving structure 200 to move it upward or away from the keg's portion 164 until the locking ribs 166 moves into the corresponding pressure-release windows 556 and retained therein such that the valving structure 200 would not dangerously "pop" out of the keg 100.

With the valving structure 200 moving upward, the outer tube 722 of the keg's portion 164 is moved away from the sealing ring 340. The gas "G" is then vented out of the keg through the coupling windows 560 and the venting ports 567 without decoupling the valving structure 200 from the neck portion 160. As the inner and outer valve assemblies 602 and 600 are closed, no liquid or gas is release through the inner and outer channels 732 and 734. In this depressurization process, the inner tube 724 may remain engagement with the bladder coupler 500, or alternatively may disengage with the bladder coupler 500 when the valving structure 200 is moved upward.

Once the keg 100 is depressurized, the valving structure 200 may be removed from the keg by pushing the twist-lock casing 520 downwardly towards the keg 100 and rotating the twist-lock casing 520 to align the locking ribs 166 with the guides 552. Then, the valving structure 200 can be safely separated from the keg's neck portion 164 for disposal.

The valving structure 200 disclosed herein greatly simplifies the depressurization of pressurized fluid containers 100. The valving structure 200 can be demountably engaged with a pressurizable fluid container 100 such as a keg by hand without the need for any additional tools. The anti-rotation protrusions or locking ribs 166 offer tamper resistance such that one has to break the tabs 551 to remove the valving structure 200 from the neck portion 164 of the keg 100.

Those skilled in the art will appreciate that the material and at least some dimensions of the twist-lock casing 520 such as the material and the thickness of the tabs 551 may affect the affordable pressure of the valving structure 200. Therefore, in some embodiments, a designer may choose suitable material and dimension measurements of the twist-lock casing 520 including those of the tabs 551 based on the pressure requirement of the valving structure 200. In some other embodiments, once the material and dimension measurements of the twist-lock casing 520 including those of the tabs 551 are determined, a maximum pressure of the valving structure 200 may be defined for ensuring safe operation of the valving structure 200.

In some embodiments, the twist-lock casing 520 may not comprise the depressurization structure. Rather, the twist-lock casing 520 may only comprise a plurality of windows 562 in connection with corresponding container-coupling guides 552 for engaging the locking ribs 166 of the keg's neck portion 164 for coupling the twist-lock casing 520 to the keg. In some embodiments, the twist-lock casing 520 may comprise threads for engaging corresponding threads on the keg's neck portion 164 for coupling the twist-lock casing 520 to the keg.

Figure 30A:
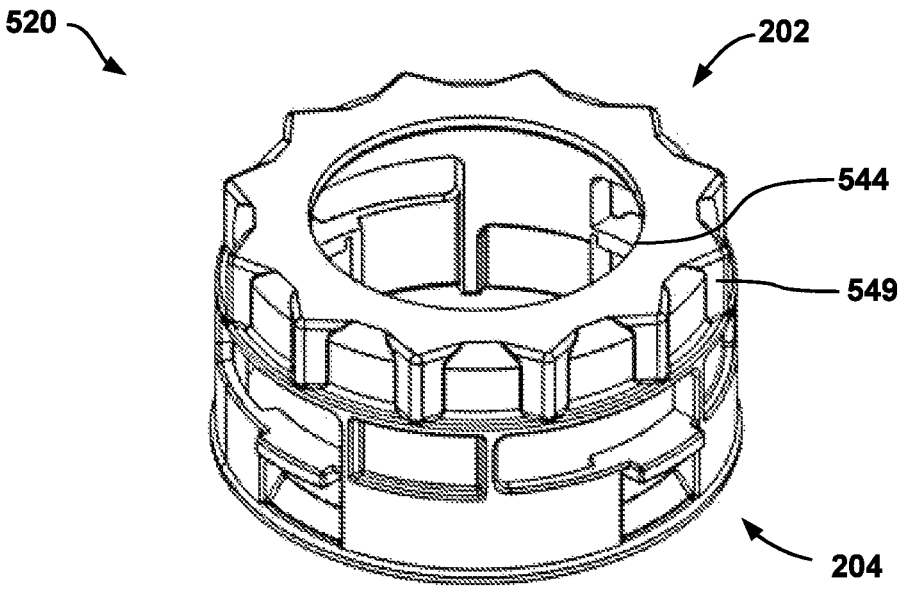
FIG. 30A and FIG. 30B are perspective and bottom views of a twist-lock casing of the valving structure shown in FIG. 6A, according to some embodiments of this disclosure.
Figure 30B:
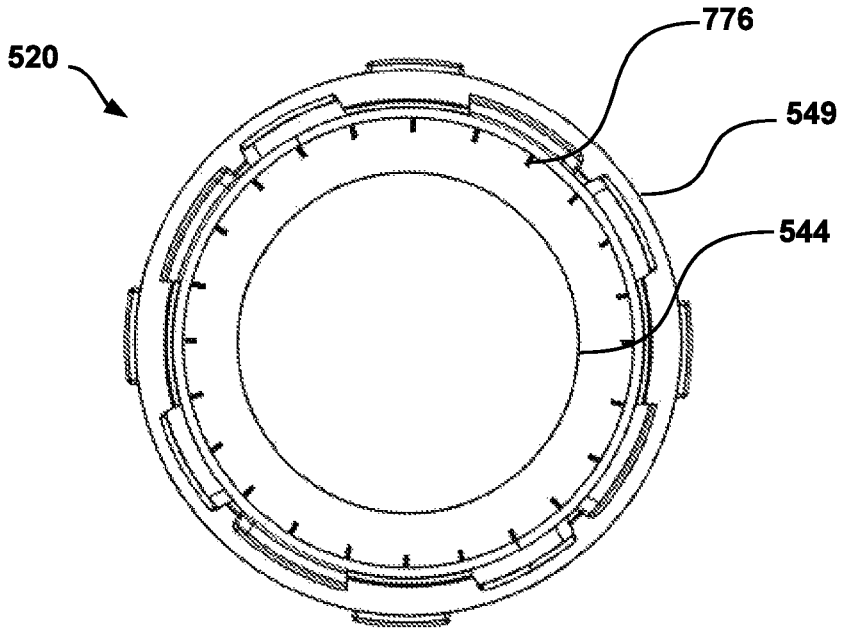

In some embodiments, the valving structure may further comprise an anti-rotation safety mechanism. FIGS. 30A and 30B shows the twist-lock casing 520 of the valving structure 200. The twist-lock casing 520 in these embodiments is similar to that shown in FIG. 22 and further comprises a plurality of ribs 776 circumferentially uniformly distributed on the inner surface of (i.e., under) the inward-extending annular rim 544 at the distal end 202 thereof. More specifically, each rib 776 in these embodiments extends from the inner surface of the interface between the inward-extending annular rim 544 and the sidewall 549.

Figure 31:
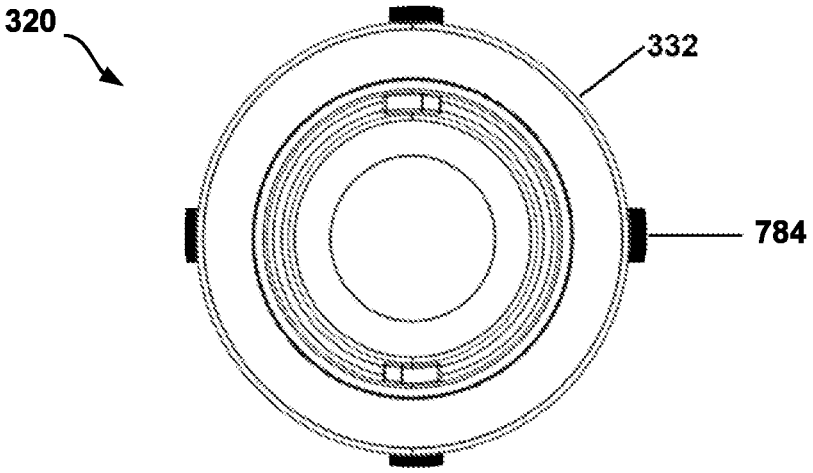
FIG. 31 is a top view of a valve body of the valving structure shown in FIG. 6A for use with the twist-lock casing shown in FIG. 30A.
Figure 32:
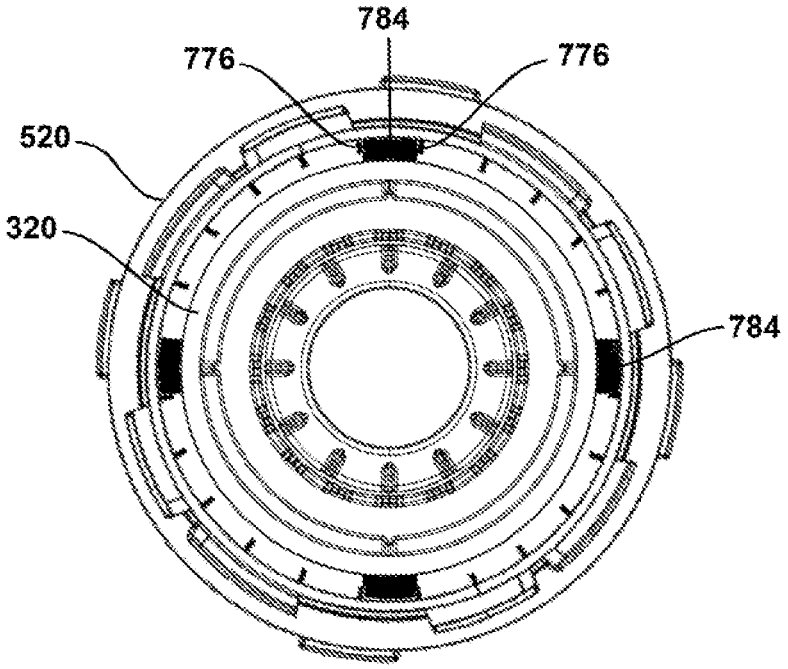
FIG. 32 is a bottom view of the valve body shown in FIG. 31 received in the twist-lock casing shown in FIG. 30A.

FIG. 31 shows the valve body 320. The valve body 320 in these embodiments is similar to that shown in FIG. 9A and further comprises at least one protrusion 784 extending from the outer edge of the outwardly-extending annular rim 332 at the distal end thereof. The at least one protrusion 784 has a circumferential width substantively equal to the spacing between adjacent ribs 776 of the valve body 320.

When the coupling valve assembly 300 is received into the twist-lock casing 520, each of the at least one protrusion 784 fits into the spacing between adjacent ribs 776 of the valve body 320 and engages the adjacent ribs 776 for preventing the rotation of the coupling valve assembly 300.

As shown in FIG. 8, a simple twist-lock cover 206 may be removably attached to the distal end 202 of the twist-lock casing 520 for covering the port 522 and protecting the coupling mechanism in the chamber 321 when no coupler is connected to the valving structure 200.

In some embodiments, a tamper-evident cover may be attached to the distal end 202 of the twist-lock casing 520 for not only protecting the chamber 321 and coupling mechanism therein when no coupler is connected to the valving structure 200 but also for providing evidence if the tamper-evident cover is tampered with.

Such a tamper-evident cover serves as a one-time use cover by requiring a keg operator to upwardly pull a ring located at the end of a pullout tab until the pullout tab breaks a top surface of the tamper-evident cover. Once the cover is broken, the cover can then be removed by moving/twisting and pulling it upward and away from the distal portion of the twist-lock casing. Because a tamper-evident cover is a one-time-use cover, if broken, it must be replaced with a new cover.

On the other hand, if a user or operator receives a keg with a broken cover, the user would understand that the cover has been tampered with and the keg and the attached valving structure may need to be cleaned or replaced to prevent the occurrence of unsanitary conditions or contamination of the fluid therein.

Figure 33A:
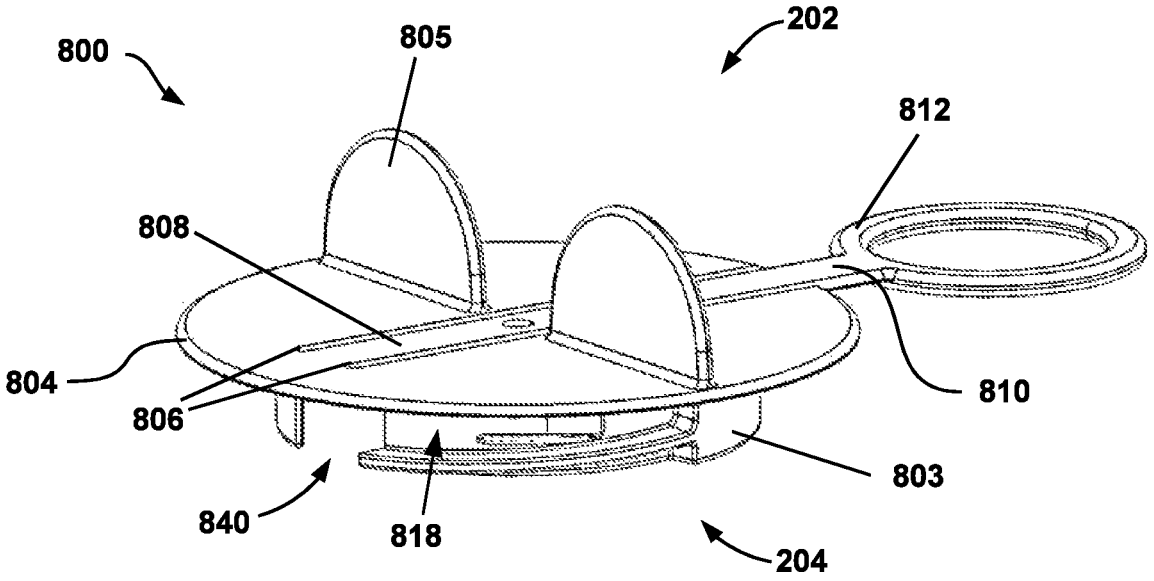
FIG. 33A and FIG. 33B are perspective views of a tamper-evident cover of the valving structure shown in FIG. 6A, according to some embodiments of this disclosure.
Figure 33B:
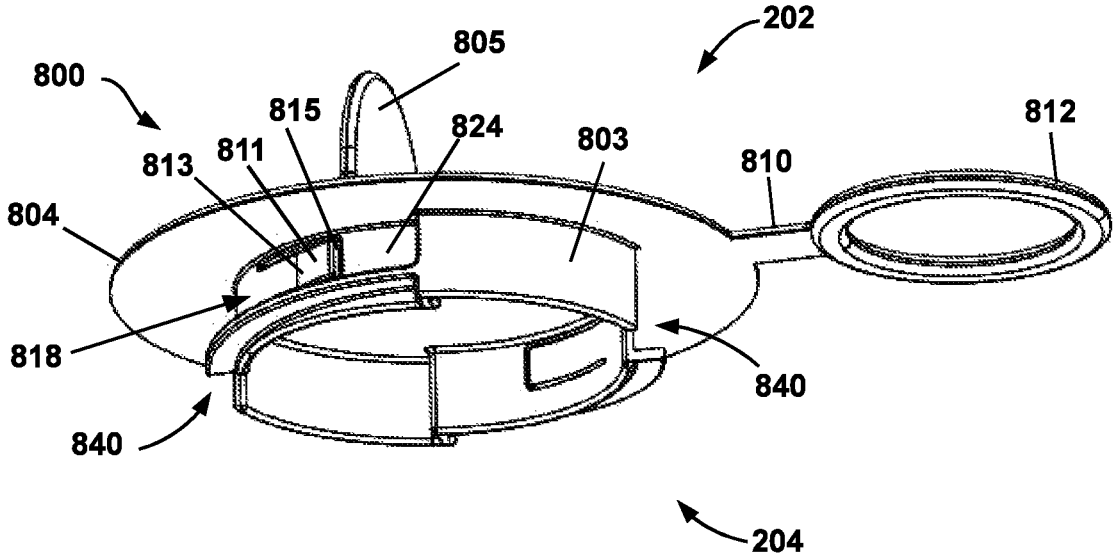
Figure 33C:
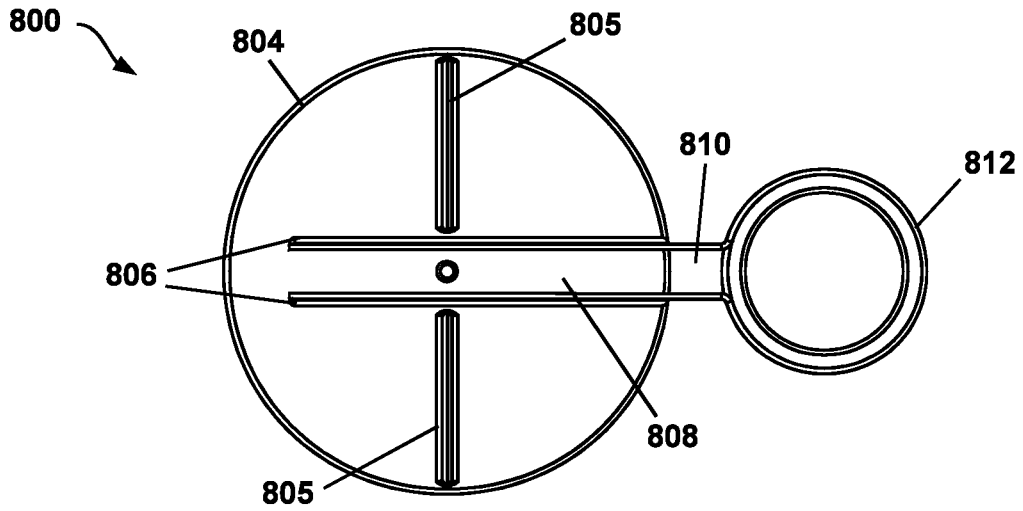
FIG. 33C is a side view of the tamper-evident cover shown in FIG. 33A.

FIGS. 33A to 33D show a tamper-evident cover 800. As shown, the tamper-evident cover 800 comprises a covering body 804 in the form of a circular plate with a size sufficient for covering the port 522 of the valving structure 200 (also see FIGS. 6A and 6B). The covering body 804 comprises, on the distal side 202 thereof, one or more handles 805 in the form of generally vertically oriented tabs for twisting or otherwise rotating the tamper-evident cover 800 to couple the tamper-evident cover 800 to the valving structure 200, and a detachable tab handle 810 radially outwardly extending from the covering body 804 and coupled to a grasping member 812 in the form of a ring. As shown in FIG. 33C, the covering body 804 comprises a pair of precut lines 806 with weakened strength about the detachable tab handle 810 and extending from positions about the edge adjacent the detachable tab handle 810 to positions adjacent the edge diametrically opposite to the detachable tab handle 810, thereby forming a detachable pullout-tab 808 which may be at least partially torn from the covering body 804 when the detachable tab handle 810 is pulled.

A circular sidewall 803 extends from the proximal side 204 of the covering body 804 with an OD substantially equal to or slightly smaller than the ID of the port 522. The sidewall 803 comprises a plurality of gaps 840 at locations corresponding to the locations of the inward protrusions 327 of the valve body 320 (not shown). Each gap 840 is in connection with a respective coupling guide 818 in the form of a recess helically extending on the sidewall 803 from a proximal location thereof towards the covering body 804. At least one gap 840 is located under and about the detachable pullout-tab 808 of the covering body 804.

Each coupling guide 818 has a height about the same or slightly larger than that of the corresponding inward protrusion 327 of the valving assembly 200 and comprises a flexible, radially outwardly extending stopper 811 having a sloped receiving surface 813 proximal to the entrance of the coupling guide 818 and an abrupt stopping surface 815 distal thereto. The stopping surface 815 is at a distance to the end of the coupling guide 818 thereby forming a locking chamber 824 therebetween. Each locking chamber 824 has a circumferential width about the same or slightly larger than that of the corresponding inward protrusion 327 of the valving assembly 200.

In these embodiments, the flexible stopper 811 is in the form of a circumferentially partially cut-off and radially outwardly biased piece of the coupling guide 818 (or more precisely the portion of sidewall 803 in the coupling guide 818) connecting to the coupling guide 818 at the side proximal to the entrance thereof. Other forms of the flexible stopper 811 may also be available. For example, in some embodiments, the portion of sidewall 803 in the coupling guide 818 is made of a flexible material and the flexible stopper 811 is a protrusion radially outwardly extending therefrom.

Figure 34:
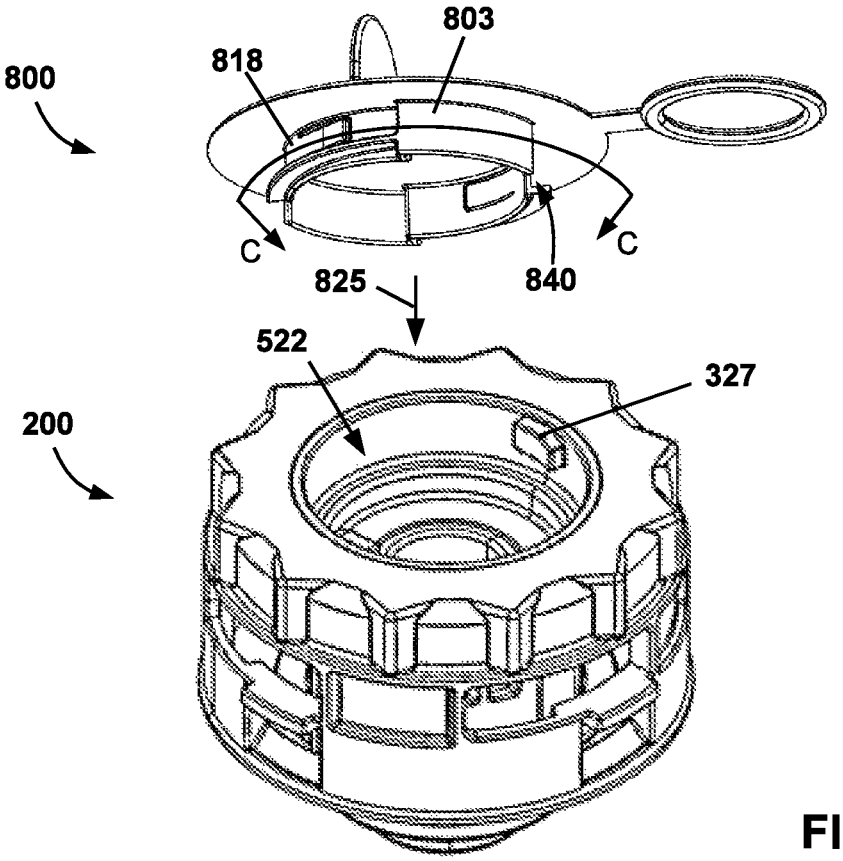
FIG. 34 is a perspective view of the tamper-evident cover shown in FIG. 33A attaching to the valving structure shown in FIG. 6A.

FIG. 34 shows the attachment of the tamper-evident cover 800 to the valving assembly 200. For ease of illustration, the angle of the tamper-evident cover 800 shown in FIG. 34 is adjusted and the keg 100 (including the neck portion 164 thereof) is not shown.

As shown, the gaps 840 of the tamper-evident cover 800 is aligned with the inward protrusions 327 of the valving assembly 200 and the tamper-evident cover 800 is pushed onto the valving structure 200 (not shown), as indicated by the arrow 825, with the sidewall 803 of the tamper-evident cover 800 extending into the port 522 of the valving assembly 200 such that the inward protrusions 327 are at the entrance of respective coupling guides 818.

Figure 35:
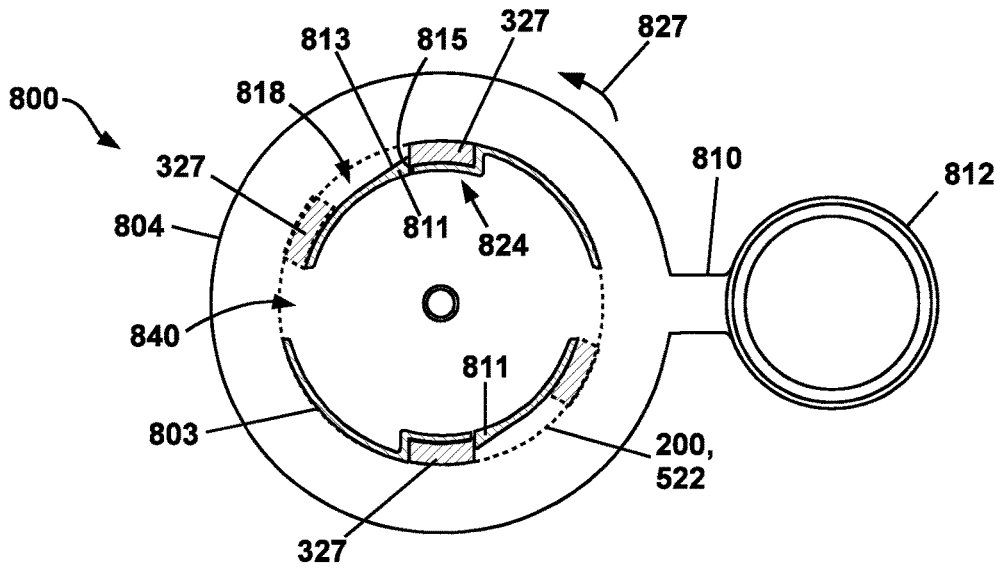
FIG. 35 is a schematic cross-sectional view of the tamper-evident cover shown in FIG. 34 along the cross-section line F-F for showing the coupling of the tamper-evident cover and the valving structure.

As shown in FIG. 35, handles 805 are then used to twist or otherwise rotate the tamper-evident cover 800 as indicated by the arrow 827 to move the inward protrusions 327 into the respective coupling guides 818. Each inward protrusion 327 moves on the sloped receiving surface 813 of the stopper 811, presses the stopper 811 radially inwardly, and eventually passes the stopper 811 and arrives the locking chamber 824. The stopper 811 is then back to its original position and the abrupt stopping surface 815 thereof engages the inward protrusion 327 to prevent the inward protrusion 327 from moving out of the locking chamber 824. The tamper-evident cover 800 is thus affixed to the valving structure 200.

Figure 36A:
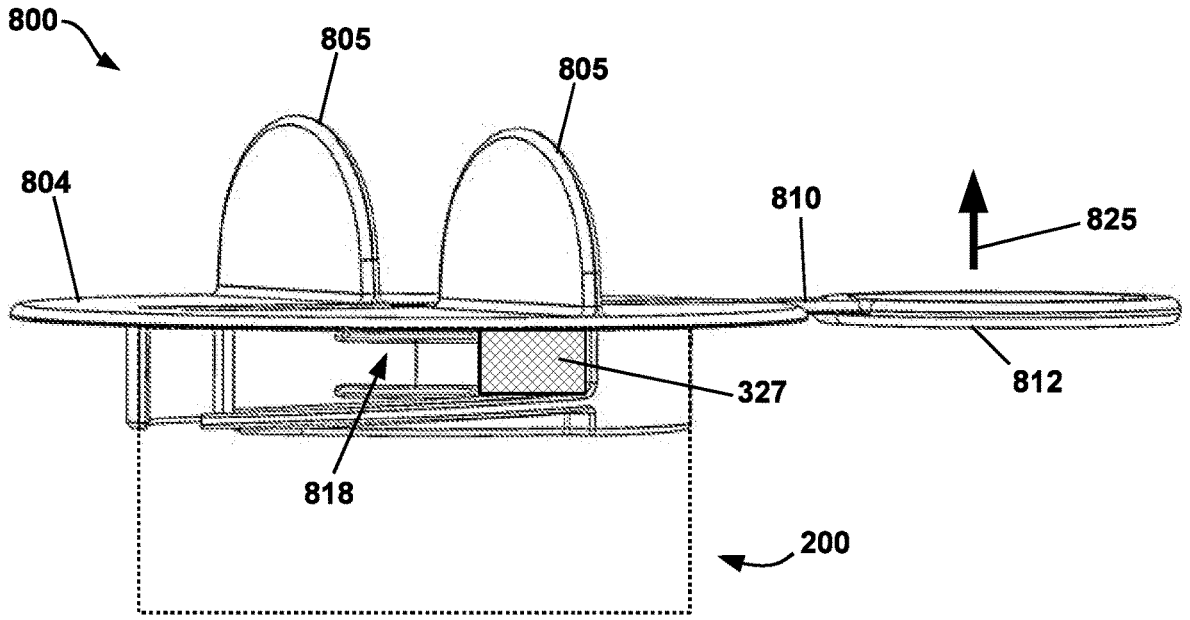
Figure 36B:
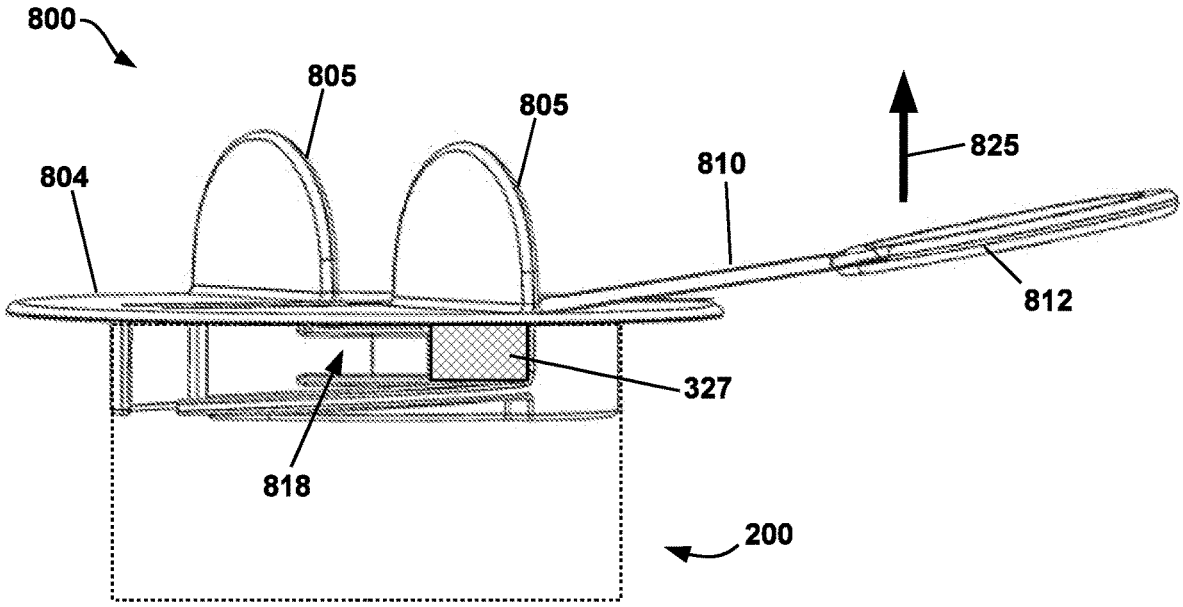
Figure 36C:
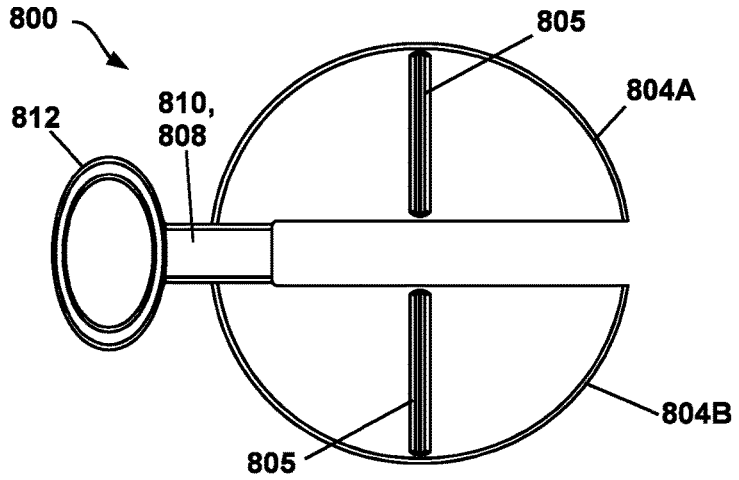
Figure 36D:
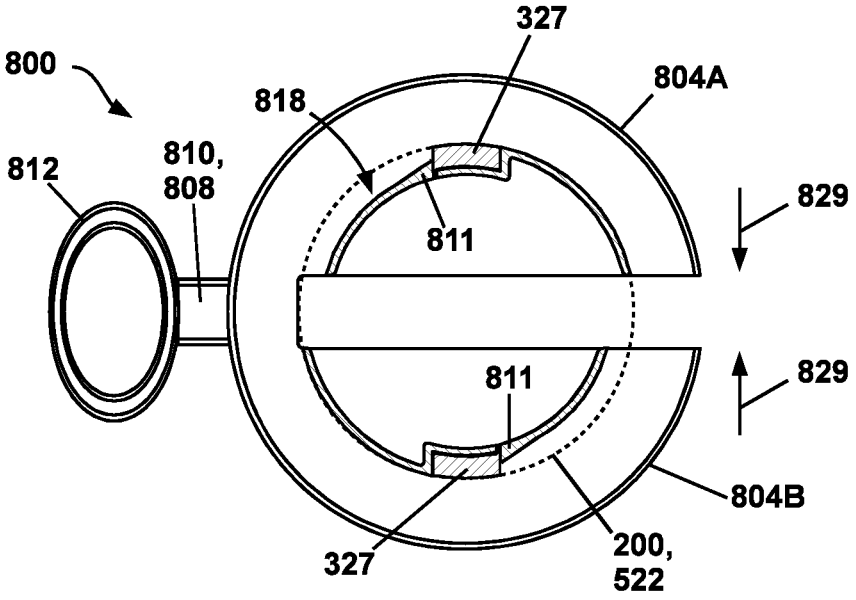

As shown in FIGS. 36A and 36B, to remove the tamper-evident cover 800 from the valving structure 200 and access the port 522 of the keg 100, an operator may pull grasping member 812 upwardly as indicated by the arrow 825 with sufficient force. The detachable pullout-tab 808 (defined by the pair of precut lines 806 with weakened strength; see FIG. 33C) is then partially torn from the covering body 804, as shown in FIGS. 36C and 36D.

The partial tearing-off of the detachable pullout-tab 808 transforms the previously integrated covering body 804 into a pair of connected covering-body pieces 804A and 804B. As shown in FIG. 36D, the operator then laterally moves the two covering-body pieces 804A and 804B towards each other as indicated by the arrow 829.

Figure 36E:
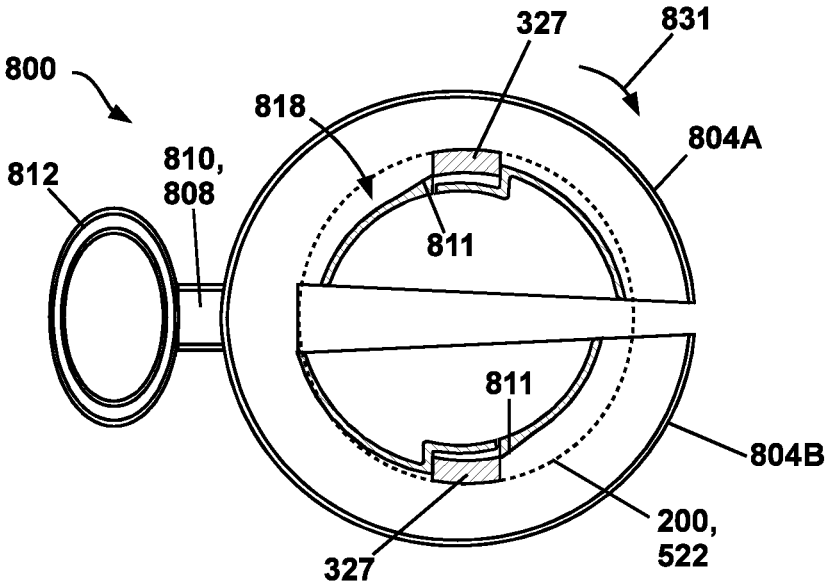

As shown in FIG. 36E, the deformation of the covering-body pieces 804A and 804B radially inwardly moves the stoppers 811 and subsequently disengages the stoppers 811 from the inward protrusions 327. The tamper-evident cover 800 is then twisted or rotated at a reverse direction as indicated by the arrow 831 to move the inward protrusions 327 out of the respective coupling guides 818 to allow the tamper-evident cover 800 to be removed from the valving structure 200.

Thus, the tamper-evident cover 800 is generally at least partially broken or otherwise disintegrated when it is removed from the valving structure 200 and such a broken cover 800 cannot be reintegrated even if it is reattached to the valving structure 200. Therefore, if a user or operator receives a keg 100 with a broken cover 800 attached thereto, the user would understand that the cover 800 has been tampered with and the keg 100 and the attached valving structure 200 may need to be cleaned or replaced to prevent the occurrence of unsanitary conditions.

Figure 37:
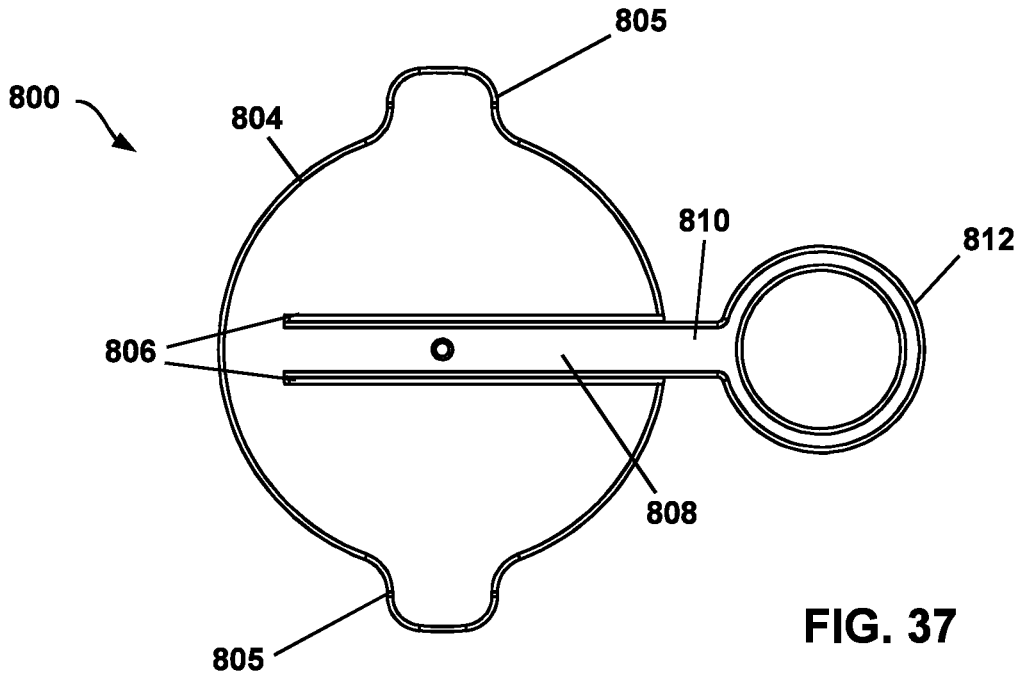
FIG. 37 is a perspective view of a tamper-evident cover of the valving structure shown in FIG. 6A, according to some embodiments of this disclosure.

FIG. 37 shows a tamper-evident cover 800 in some alternative embodiments. The tamper-evident cover 800 in these embodiments is similar to that shown in FIG. 33A except that the one or more handles 805 of the tamper-evident cover 800 in these embodiments are not vertically oriented. Rather, the one or more handles 805 in these embodiments are laterally and radially outwardly extended from opposite edges of the covering body 804.

In above embodiments, the tamper-evident cover 800 comprises a ring-shaped grasping member 812 at the outer end of the detachable tab handle 810. In some alternative embodiments, the grasping member 812 may be in any suitable shape.

In some alternative embodiments, the tamper-evident cover 800 may not comprise any grasping member 812.

Figure 38:
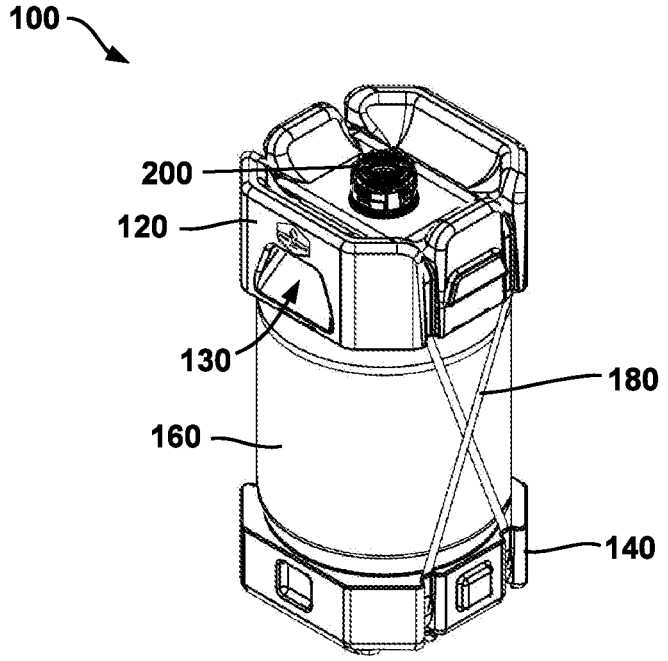
FIG. 38 is a perspective view of a pressurizable fluid container, according to some embodiments of this disclosure.

In above embodiments, the keg 100 comprises two bands 180 for coupling the top endcap 120, the bottle 160, and the bottom endcap 140. In some embodiments as shown in FIG. 38, the keg 100 may comprise a single band 180 for coupling the top endcap 120, the bottle 160, and the bottom endcap 140.

Although embodiments have been described above with reference to the accompanying drawings, those of skill in the art will appreciate that variations and modifications may be made without departing from the scope thereof as defined by the appended claims.

What is claimed is:

1. A valving structure for demountably coupling to a neck portion of a pressurizable fluid container, the valving structure comprising:

a twist-lock casing for demountably coupling to the neck portion of the pressurizable fluid container, the twist-lock casing having a longitudinal bore; and a coupling valve assembly received in the longitudinal bore of the twist-lock casing;

wherein the twist-lock casing comprises one or more windows on a sidewall thereof for engaging one or more outwardly extending protrusions on the neck portion for coupling and locking the valving structure to the neck portion;

wherein each of the one or more windows comprises:

a receiving window portion in connection with a container-coupling guide extending from the receiving window portion along an inner surface of the twist-lock casing to a proximal edge thereof, for receiving a corresponding one of the one or more outwardly extending protrusions of the neck portion, a locking window portion circumferentially extending from the receiving window portion, the locking window portion comprising a stopper on a proximal edge thereof at a location between the receiving window portion and the locking window portion for locking the corresponding outwardly extending protrusion in the locking window portion, and a pressure-release window portion adjacent a proximal side of the locking window portion and separated therefrom by a removable tab; and wherein the twist-lock casing is configured such that, when the removable tab of each of the one or more windows is removed, the twist-lock casing moves under a pressure from the pressurizable fluid container along a direction away from the neck portion for moving the one or more outwardly extending protrusions into their corresponding pressure-release window portions and for releasing pressure of the fluid container without decoupling the valving structure from the neck portion.

2. The valving structure of claim 1, wherein the coupling valve assembly further comprises:

a valve body demountably affixed between the twist-lock casing and the neck portion of the pressurizable fluid container, the valve body comprising an outer sidewall and an inner sidewall, the outer sidewall comprising a plurality of ports thereon and enclosing therein a longitudinal bore between a distal port and a proximal port thereof, the inner sidewall defining the proximal port, the annulus between the inner and outer sidewalls receiving therein an outer compressible spring;

an outer valve assembly comprising a longitudinal bore and movably received in the bore of the valve body, the outer valve assembly engaging the outer compressible spring and movable between an open position for opening the bore of the valve body and a closed position for closing the bore of the valve body, the inner sidewall of the valve body engaging and aligning the outer valve assembly; and an inner valve assembly movably received in the longitudinal bore of the outer valve assembly, the inner valve assembly engaging an inner compressible spring in the longitudinal bore of the outer valve assembly and movable between an open position for opening the bore of the outer valve assembly and a closed position for closing the outer valve assembly.

3. The valving structure of claim 2, wherein the outer valve assembly defines and controls the open and close of an outer channel through the annulus between the valve body and the outer valve assembly, the plurality of ports on the outer sidewall of the valve body, and the annulus between the valve body and the neck portion; and wherein the inner valve assembly defines and controls the open and close of an inner channel through the bore of the outer valve assembly.

4. The valving structure of claim 2, wherein the coupling valve assembly further comprises a bladder coupler coupled to the outer valve assembly for coupling to a flexible inner container received in the pressurizable fluid container and for establishing fluid communication between the inner channel and the flexible inner container.

5. The valving structure of claim 2, wherein the twist-lock casing comprises a plurality of ribs circumferentially uniformly distributed about the longitudinal bore of the twist-lock casing; and wherein the valve body of the coupling valve assembly comprises at least one protrusion for fitting into the space between an adjacent pair of the plurality of ribs and engaging the adjacent pair of ribs for preventing rotation of the coupling valve assembly.

* * * * *